US012326143B2

(12) United States Patent
Pahlevan et al.

(10) Patent No.: US 12,326,143 B2
(45) Date of Patent: Jun. 10, 2025

(54) LONGITUDINAL IMPEDANCE PUMP

(71) Applicant: University of Southern California, Los Angeles, CA (US)

(72) Inventors: Niema Mohammed Pahlevan, Los Angeles, CA (US); Arian Aghilinejad, Los Angeles, CA (US)

(73) Assignee: UNIVERSITY OF SOUTHERN CALIFORNIA, Los Angeles, CA (US)

( * ) Notice: Subject to any disclaimer, the term of this patent is extended or adjusted under 35 U.S.C. 154(b) by 78 days.

(21) Appl. No.: 18/511,735

(22) Filed: Nov. 16, 2023

(65) Prior Publication Data

US 2024/0167467 A1 May 23, 2024

Related U.S. Application Data

(60) Provisional application No. 63/426,463, filed on Nov. 18, 2022.

(51) Int. Cl.
*F04B 43/08* (2006.01)
*F04B 43/00* (2006.01)

(52) U.S. Cl.
CPC ..... *F04B 43/084* (2013.01); *F04B 43/0072* (2013.01); *F04B 43/088* (2013.01)

(58) Field of Classification Search
CPC ..... F04B 43/08; F04B 43/086
See application file for complete search history.

(56) References Cited

U.S. PATENT DOCUMENTS

| | | | | |
|---|---|---|---|---|
| 2,068,196 | A * | 1/1937 | Rawlings | F04B 43/084 417/389 |
| 4,199,307 | A * | 4/1980 | Jassawalla | F04B 43/0072 417/474 |
| 12,188,466 | B2 * | 1/2025 | Hopkins | A41D 1/00 |
| 12,228,122 | B2 * | 2/2025 | Vieille | F04B 43/0018 |
| 2006/0074325 | A1 * | 4/2006 | Karo | A61B 5/022 600/494 |
| 2008/0193307 | A1 * | 8/2008 | Elata | F04B 43/1223 417/474 |
| 2013/0216400 | A1 * | 8/2013 | Bucher | F04B 43/08 417/474 |

* cited by examiner

*Primary Examiner* — Bryan M Lettman
(74) *Attorney, Agent, or Firm* — Pillsbury Winthrop Shaw Pittman LLP

(57) ABSTRACT

A longitudinal stretching based wave pumping system and corresponding methods. A stretchable tube is configured to hold a fluid. An actuator is coupled to the tube. The actuator is configured to longitudinally stretch and release the stretchable tube to create waves on the stretchable tube and within the fluid that propagate and reflect at one or more reflection sites along the stretchable tube to create wave pumping, which drives the fluid and generates net flow in a flow direction.

20 Claims, 20 Drawing Sheets

TABLE I. Physical parameters used in the model.

| Physical parameter | Symbol | Value |
|---|---|---|
| Solid wall thickness (m) | $t_s$ | 0.001 |
| Solid wall density (kg/m$^3$) | $\rho_s$ | 1050 |
| Poisson ratio of the solid wall | $\upsilon_s$ | 0.45 |
| Fluid density (kg/m$^3$) | $\rho_f$ | 1050 |
| Fluid viscosity (Pa s) | $\mu_f$ | 0.005 |
| Fluid domain radius (m) | $r_f$ | 0.015 |

Algorithm of Longitudinal Wave Pumping System Model.

Input: fluid-filled elastic tube model $L$, $r_f$, $t_s$, $E_s$, $\mu_f$, $\rho_f$, $\rho_s$, $\nu_s$

Input: boundary parameters $SR$, $f$, duty cycle ($DC$)

Input: discretization ($\Delta t$) and number of cycles to simulate ($\Rightarrow$ final time $t_f$)

Initialize: solid and fluid domains with zero velocity and stress

```
while t < t_f do
    if (mode(t, T) < DC) then                          // T ← 1/f
        prescribe velocity profile to the tube root    // active stretching (Fig. 2)
    else
        zero traction to the tube root                 // passive recoil
    end
    solve for fluid pressure and velocity fields at t + Δt   // via Eq. (1) and (2)
    prescribe the fluid forces at the fluid-structure interface   // via Eq. (3)
    solve for solid displacement and stress fields at t + Δt   // via Eq. (4)
    apply no-slip condition at the fluid-solid interface, t ← t + Δt   // via Eq. (5) and (6)
end
```

Output: Numerical solutions for $\boldsymbol{v}(\boldsymbol{x}, t)$, $p(\boldsymbol{x}, t)$ and $\boldsymbol{u}(\boldsymbol{X}, t)$ on $[0, t_f]$

FIG. 9

TABLE II. Parameter settings for different case studies.

| Physical parameter | Symbol | Range |
|---|---|---|
| Length of the tube (m) | $L$ | [0.125, 0.50] |
| Wall elasticity (kPa) | $E_s$ | [100, 900] |
| Stretching over length ratio | $SR$ | [0.04, 0.10] |
| Stretching frequency (Hz) | $f$ | [0.5, 4] |

FIG. 10

LONGITUDINAL IMPEDANCE PUMP

BACKGROUND

1. Field

The present disclosure relates generally to impedance pumps.

2. Description of the Related Art

Valveless pumping is used for producing and amplifying a net flow at various physical scales. An advantage of valveless pumping devices is that pumping components are not in contact with circulating fluid which makes them of particular interest in biomedical research and the aerospace industry, for example. Valveless pumping in straight elastic tubes can be achieved either by the use of impedance mismatch or by peristaltic motion. In a peristaltic pump, successive compressions along the tube are used to push the fluid from one end of the tube to the other by positive displacement. In impedance-based devices, pumping can be achieved through wave generation via periodic compression of a deformable tube asymmetrically from its interfaces to tube elements of different characteristics. Unlike peristaltic pumps, a single actuation location is sufficient in an impedance pump to produce unidirectional flow waveforms.

SUMMARY

The following is a non-exhaustive listing of some aspects of the present techniques. These and other aspects are described in the following disclosure.

Some aspects relate to stretch-related wave propagation and reflection in a fluid-filled compliant tube used to create a wave pumping system. A longitudinal stretching based wave pumping system and corresponding methods are described. A stretchable tube is configured to hold a fluid. An actuator is coupled to the tube. The actuator is configured to longitudinally stretch and release the stretchable tube to create waves on the stretchable tube and within the fluid that propagate and reflect at one or more reflection sites along the stretchable tube to create wave pumping, which drives the fluid and generates net flow in a flow direction.

In some embodiments, the reflection sites comprise a stiffened portion of a wall of the stretchable tube, a bifurcation in the stretchable tube, and/or a connection to a rigid tube.

In some embodiments, the stretchable tube comprises an elastic material.

In some embodiments, the stretchable tube is fixed at or near an outlet end, and configured to be stretched by the actuator at or near an inlet end. In some embodiments, the outlet end is fixed at a single point to create wave reflection.

In some embodiments, the actuator comprises a cam follower mechanism and a stepper motor configured to drive the cam follower mechanism.

In some embodiments, a length of the stretchable tube is configured to be changed to modify a reflection site and/or a pumping rate. In some embodiments, an elasticity of the stretchable tube is configured to be changed to modify a speed of wave propagation and/or the pumping rate. In some embodiments, a wall thickness of the stretchable tube is configured to be changed to modify the speed of wave propagation and/or the pumping rate. In some embodiments, an inner radius of the stretchable tube is configured to be changed to modify the speed of wave propagation and/or the pumping rate.

In some embodiments, a stretching frequency from the actuator is configured to be set to achieve a maximum pumping volume of the fluid based on wave characteristics in the stretchable tube including elasticity, frequency, and locations of reflection sites.

In some embodiments, the system comprises a hydraulic circuit. The hydraulic circuit comprises a controller coupled to the actuator and configured to control the actuator to stretch and release the stretchable tube. The controller may be configured to control the actuator to stretch and release the stretchable tube at a specific frequency, with a specific magnitude, over a specific time. In some embodiments, the specific time is a period of an oscillatory cycle.

In some embodiments, the hydraulic circuit comprises a reservoir tank configured to supply the fluid, a fixture configured to hold the stretchable tube and/or the actuator, one or more sensors configured to generate one or more output signals conveying information related to stretching and releasing of the stretchable tube by the actuator and/or pumping by the stretchable tube, and/or a data recorder configured to record the information in the one or more output signals.

In some embodiments, the actuator comprises a first portion configured for longitudinally stretching a first portion of an elastic deformable wall on a first side of the stretchable tube to create waves that propagate on the first side of the stretchable tube, and a second portion configured for longitudinally stretching a second portion of the elastic deformable wall on a second side of the tube to create symmetric stretching on the first and second sides of the stretchable tube.

In some embodiments, the stretchable tube comprises a rigid connector configured to couple the first side of the stretchable tube to the second side of the stretchable tube.

In some embodiments, the stretchable tube and the actuator comprise a micro or nano scale structure.

In some embodiments, the stretchable tube is tapered.

In some embodiments, the stretchable tube comprises one or more side branches. One or more actuators may be coupled to the one or more side branches to longitudinally stretch and release the one or more side branches.

Some aspects include a pumping method comprising one or of the operations performed by the pumping system described above.

Some aspects include a tangible, non-transitory, machine-readable medium storing instructions that when executed by a data processing apparatus cause the data processing apparatus to perform or control one or more operations of the above-mentioned process(es).

Some aspects include a tangible, non-transitory, machine-readable medium storing instructions that when executed by a data processing apparatus cause the data processing apparatus to execute an electronic computational model of the pumping system, and/or one or more operations of the above-mentioned process(es).

BRIEF DESCRIPTION OF THE DRAWINGS

The above-mentioned aspects and other aspects of the present techniques will be better understood when the present application is read in view of the following figures in which like numbers indicate similar or identical elements:

FIG. 9 illustrates example inputs, an algorithm, and outputs of the computational model summarized as a pseudocode, in accordance with various embodiments.

FIG. 10 illustrates a second table, which lists various example parameter settings for different possible pumping systems (e.g., the pumping system shown in FIG. 2), in accordance with various embodiments.

Figure 1:
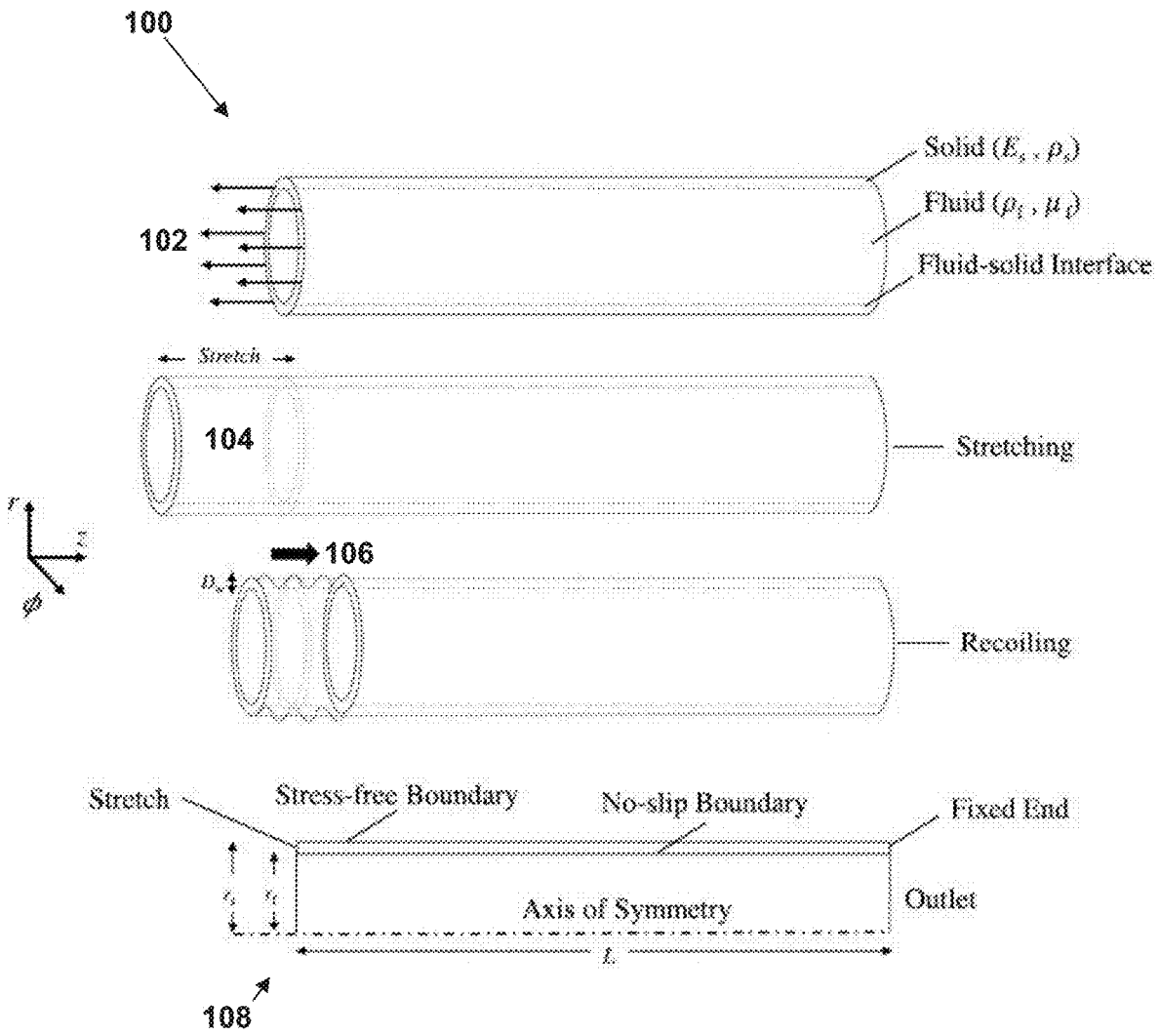
FIG. 1 illustrates a stretchable tube, as a schematic representation of a longitudinal impedance pump, in accordance with various embodiments.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF CERTAIN EMBODIMENTS

To mitigate the problems described herein, the inventors had to both invent solutions and, in some cases just as importantly, recognize problems overlooked (or not yet foreseen) by others in the field of impedance pumping. Indeed, the inventors wish to emphasize the difficulty of recognizing those problems that are nascent and will become much more apparent in the future should trends in industry continue as the inventors expect. Further, because multiple problems are addressed, it should be understood that some embodiments are problem-specific, and not all embodiments address every problem with traditional systems described herein or provide every benefit described herein. That said, improvements that solve various permutations of these problems are described below.

The driving mechanism in impedance pumps is the result of the interaction of elastic waves which ultimately leads to the non-linear dependency of the flow on the excitation frequency. In its simplest from, an impedance pump may comprise a fluid-filled elastic tube connected to stiffer tube elements at its two ends which act as reflection sites, and a wave generator such as a pincher. The elastic flexible tube is pinched at an off-centered position relative to its ends. The periodic partial or complete pinching at a pinching frequency and amplitude generates a complex series of waves which reflect at the rigid connections. As a result of these complex wave dynamics, a net flow in a certain direction is achieved. The flow amplitude and direction are highly dependent on the frequency, amplitude, and location of pinching.

While an impedance pumping system can serve as an energy-efficient and simple flow generator, there are technical challenges that limit the applicability of such devices. The low mean flow rates seen in previous systems are troublesome since they offer little use for real flow improvement, especially in physiologically relevant settings. In addition, there are disagreements on the optimal performing condition of conventional impedance pumps due to the complexity of their characteristic behavior.

The present systems and methods are based on physics of waves that the longitudinal stretch of a deformable medium (e.g., elastic or otherwise stretchable tube 100 shown in FIG. 1) can create a pumping mechanism constructed by wave propagations and reflections. Both the direction and the magnitude of the net flow in the pumping system depend on the wave dynamic characteristics. These systems and methods utilize a combination of an excitation system (e.g., one or more actuators described below) to apply stretching on the stretchable wall of a tube, and one or more reflection sites along the tube. This wave pumping system is novel and unique at least since (i) it uses longitudinal stretching of fluid-filled deformable medium such as stretchable tubes and (ii) its excitation mechanism comprises an active stretch and passive recoil. The system (a pump) can be controlled via various mechanisms described below.

This longitudinal wave pumping and the conventional impedance pumping differ in their wave-generating system. To understand the underlying mechanism in the longitudinal stretching-based impedance pump, a computational model of a fluid filled stretchable tube with fluid-structure interaction modeling is described. The pump's behavior is characterized as a function of various stretching parameters as well as different wave characteristics. Generally, wave dynamics in a compliant tube are dominated by three parameters: (1) the fundamental frequency of the propagating waves; (2) wave speed, which is determined by the material property of the medium; and (3) the locations of reflection sites.

FIG. 1 illustrates a stretchable tube 100, as a schematic representation of a longitudinal impedance pump. Different phases during one pumping cycle are shown. An illustrative sketch of the axisymmetric model and the computational boundaries are also shown. FIG. 1 illustrates stretchable tube 100 in a stretching 102 state, a stretched 104 state, a recoiling 106 state, and in a cross sectional 108 state. Stretchable tube 100 may have a specific elasticity, inner and/or outer radius r (e.g., $r_s$ and/or $r_f$ shown in FIG. 1—the radii of the solid and fluid domains, respectively, with an r=0 dotted line illustrated at the cross section root of stretchable tube 100), wall thickness, length (e.g., L shown in FIG. 1), and/or other properties. The root of the tube refers to the location where the stretching happens. $E_s$ and $\rho_s$ are the module of elasticity and the density of the solid wall of stretchable tube 100, and $\rho_f$ and $\mu_f$ are the density and viscosity of the fluid, respectively.

In this example, stretchable tube 100 comprises a straight cylindrical tube filled with water, with one end fixed (i.e., the right hand side of stretchable tube 100 in FIG. 1) and the other stretched cyclically at frequency $f$. As described above, in this figure, $r_f$ is the radius of the fluid domain, $r_s$ is the radius of the solid domain, and the difference between the two is the wall thickness ($t_s$). The cylindrical coordinate system is also employed with radial component r, azimuth $\phi$, and axial component z. Each period of the cyclic stretching comprises two phases: stretching 102 and recoiling 106. The elastic wall of stretchable tube 100 is first stretched to a distance and then released during the recoil phase. The recoil is passive, meaning it is only due to the elasticity of the tube wall. The elastic recoil results in wave propagation along the wall with initial amplitude $D_w$ which is reflected upon reaching the fixed outlet.

Fluid motion is computed using the continuity and conservation of momentum equations of an incompressible fluid given by:

$$\nabla\cdot v=0, \tag{1}$$

$$\rho_f\dot{v}+\rho_f(v\cdot\nabla)v-\nabla\cdot T_f-f=0, \text{ and} \tag{2}$$

$$T_f=-pI+\mu(\nabla v+\nabla v^T), \tag{3}$$

where v is fluid velocity, $\rho_f$ is fluid density, $T_f$ is the fluid stress tensor (for a Newtonian and incompressible fluid), $f$ is the body force, p is the pressure, I is the identity tensor, and $\mu$ is the fluid dynamic viscosity.

Motion of the linearly elastic vessel wall of stretchable tube 100 in FIG. 1 may be determined using the Lagrangian form of the momentum balance equation given by:

$$\frac{\partial T_s}{\partial X}+F=\rho_s\ddot{u}_s, \tag{4}$$

where X is the position of a material point, $T_s$ is the solid stress tensor (considered a linear elastic material), F is the vector of external force, $\rho_s$ is the vessel wall density, and $\ddot{u}_s$ is the wall acceleration. At the fluid-structure interface, the fluid is fully coupled to the solid. The conditions applied to the fluid-structure interface are displacement compatibility and traction equilibrium between the two surfaces (see Eq. (5) and (6)). Applying a no slip boundary condition at this interface, the fluid-structure coupling conditions are given by:

$$r=r_f\text{: } v=\dot{u}, \text{ and} \tag{5}$$

$$r=r_f\text{: } n\cdot T_f=n\cdot T_s, \tag{6}$$

where $\dot{u}$ is the solid velocity and n is the normal vector of the fluid-solid interface in Eq. (6). To ensure total wave reflection, outlet of the vessel was fixed (Eq. (7)), such that:

$$u=0, \text{ at } z=L. \tag{7}$$

Figure 2:
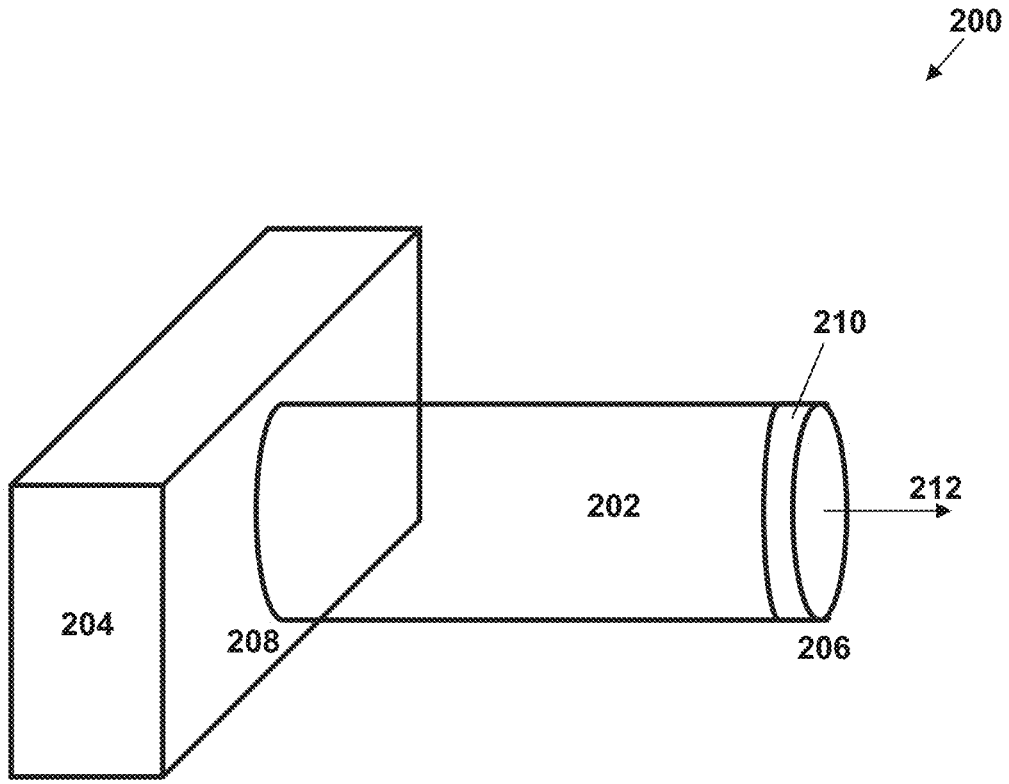
FIG. 2 illustrates an example pumping system, in accordance with various embodiments.

FIG. 2 illustrates a pumping system 200. System 200 illustrates a stretchable tube 202, an actuator 204, and/or other components. Stretchable tube 202 may be similar to and/or the same as stretchable tube 100 shown in FIG. 1. In FIG. 2, stretchable tube is orient the same as the tubes shown in FIG. 1, with an outlet end 206 on the right side of stretchable tube 202, and a stretch end (or inlet end 208 as described below) on the other side, coupled to actuator 204. Note that stretchable tube 202 and actuator 204 may be formed at more or more different scales. For example, stretchable tube 202 and actuator 204 may comprise a micro or nano scale structure. As another example, stretchable tube 202 and actuator 204 may comprise a physiological scale structure, configured to model the heart and/or other elements of human and/or animal anatomy.

Stretchable tube 202 is configured to hold fluid. The fluid may include water, blood, a chemical solution, oil, paint, and/or other fluids. In some embodiments, the fluid may be a Newtonian fluid. In some embodiments, the fluid may be a non-Newtonian fluid (e.g., paint as one example). In some embodiments, the fluid may be a non-Newtonian fluid. Stretchable tube 202 may be formed from one or more materials. In some embodiments, stretchable tube 202 comprises an elastic material (e.g., rubber, silicone, Latex, human tissue, etc.), for example. Stretchable tube 202 may have a specific elasticity (e.g., from about 50 Kpa to about 10,000 Kpa), inner and/or outer radius r (e.g., $r_s$ and/or $r_f$ shown in FIG. 1), wall thickness ($t_s$ described herein), length (e.g., L shown in FIG. 1), and/or other properties. Note that this system works with any sized tube provided it can be stretched. Stretchable tube 202 may be fixed at or near outlet end 206, and configured to be stretched by actuator 204 (as described herein) at or near inlet end 208. As a representative example that corresponds to stretching the root of the human aorta, stretching may be approximately in the range of 0.5 cm to 2 cm. In some embodiments, stretchable tube 202 comprises a rigid connector configured to couple a first side of the stretchable tube to a second side of the stretchable tube. In some embodiments, stretchable tube 202 is tapered, has one or more side branches, and/or has other characteristics.

Actuator 204 is configured to longitudinally stretch and release (e.g., as shown in FIG. 1) stretchable tube 202. Actuator 204 is coupled to stretchable tube 202. Actuator 204 may be coupled to stretchable tube 202 using a fixture, adhesive, clips, clamps, nuts, bolts, via an orifice or channel in actuator 204, and/or using other techniques. An example of such coupling can be as follows: the tube root may be coupled to a stretching apparatus, which can move horizontally to generate longitudinal waves in the tube. Connection of the tube to the stretching apparatus may be achieved via friction mounting, for example, on the inlet of the tube, which may be held with a gasket. In some embodiments, actuator 204 comprises a cam follower mechanism and a stepper motor configured to drive the cam follower mechanism, and electrical actuator, a magnetic actuator, and/or other components.

Actuator 204 is configured to longitudinally stretch and release stretchable tube 202 to create waves on stretchable tube 202 and within the fluid that propagate and reflect at one or more reflection sites 210 along stretchable tube 202 to create wave pumping, which drives the fluid and generates net flow in a flow direction 212. Reflection site(s) 210 may comprise a stiffened portion of a wall of stretchable tube 202, a bifurcation in stretchable tube 202, a connection to a rigid tube, and/or other reflection sites. For example, outlet end 206 of stretchable tube 202 may be fixed at a single point to create wave reflection and/or for other purposes. In some embodiments, a reflection site 210 may be located at an outlet end 206 of stretchable tube 202. However, note that there may be multiple reflection sites 210, reflection sites located in different positions, and/or other possible embodiments.

Pumping by pump system 200 may be the result of the net impact of suction, created due to the stretching, and compression waves created as a result of the interaction between propagating and reflected waves due to the presence of a reflection site 210. The unique frequency-dependence of the net flow rate implies an impedance-driven flow. Both the direction and amplitude of the net generated flow depend strongly on the wave dynamic characteristics including the stretching frequency, the tube wall elasticity, and the tube length (as described in more detail below). For an energetic mode of the tube wall (again as further described below), the effects of the pressure suction due to the stretching are dominant and the net generated flow is negative (reverse pumping). A transition in the tube wall displacement mode leads to the resonance-like behavior in a mean flow-frequency pattern which ultimately results in the flow pumping (positive generated flow). Pumping system 200 has potential practical implications in biomedical applications, for example, where such pumps could improve assist devices and aid in valveless flow circulation. Other potential applications are contemplated.

Figure 3:
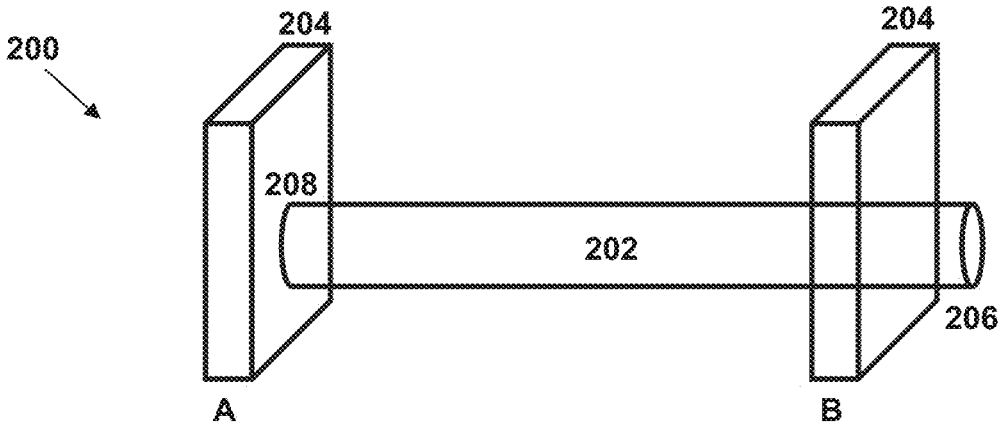
FIG. 3 illustrates how, in some embodiments, an actuator of the pumping system comprises a first portion configured for longitudinally stretching a first portion of an elastic deformable wall on a first side of a stretchable tube to create waves that propagate on the first side of the stretchable tube, and a second portion configured for longitudinally stretching a second portion of the elastic deformable wall on a second side of the tube to create symmetric stretching on the first and second sides of the stretchable tube (to enhance pumping).

FIG. 3 illustrates how, in some embodiments, actuator 204 comprises a first portion A configured for longitudinally stretching a first portion of an elastic deformable wall on a first side (e.g., at or near inlet end 208) of stretchable tube 202 to create waves that propagate on the first side of stretchable tube 202, and a second portion B configured for longitudinally stretching a second portion of the elastic deformable wall on a second side (e.g., at or near outlet end 206) of tube 202 to create symmetric stretching on the first and second sides of stretchable tube 202. This symmetric stretching may enhance pumping by pumping system 200, for example. In some embodiments, actuator 204 comprises additional portions (e.g., two, three, four, five, or more additional portions) that act together to longitudinally stretch other portions of stretchable tube 202 to create the symmetric stretching for enhanced pumping.

Figure 4:
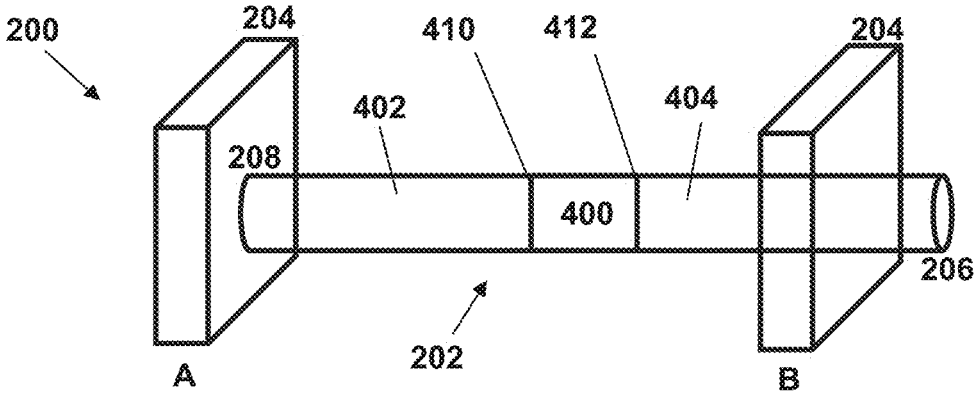
FIG. 4 illustrates the stretchable tube comprising a rigid connector configured to couple a first side of the stretchable tube to a second side of the stretchable tube, in accordance with various embodiments.

FIG. 4 illustrates stretchable tube 202 comprising a rigid connector 400 configured to couple a first side 402 of stretchable tube 202 to a second side 404 of stretchable tube 202. As described above, reflection site(s) 210 (FIG. 2) may comprise a stiffened portion of a wall of stretchable tube 202, a bifurcation in stretchable tube 202, a connection to a rigid tube, and/or other reflection sites. Rigid connector 400 and/or the actual connection (points) 410 and 412 between rigid connector 400 and first side 402 and second side 404 of stretchable tube 202 may form reflection sites 210, for example.

Figure 5:
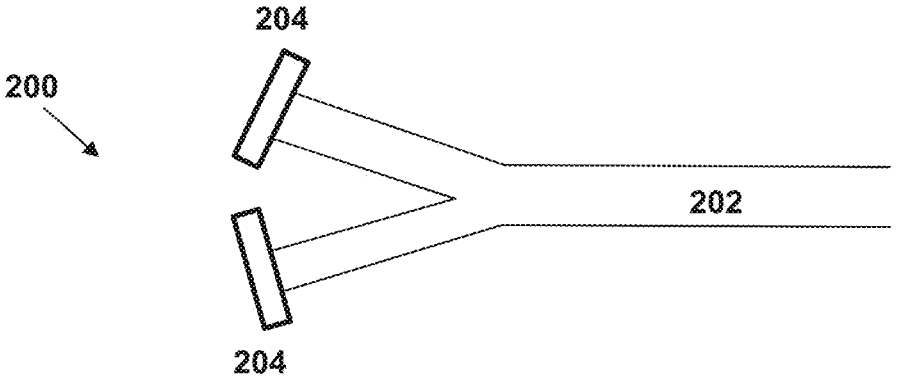
FIG. 5 illustrates how, in some embodiments, (e.g., when the stretchable tube comprises one or more side branches), one or more actuators may be coupled to one or more side branches to longitudinally stretch and release the one or more side branches (to cause pumping), in accordance with various embodiments.

FIG. 5 illustrates how, in some embodiments, (e.g., when stretchable tube 202 comprises one or more side branches 500 and 502), one or more actuators 204 may be coupled to one or more side branches 500 and 502 to longitudinally stretch and release one or more side branches 500 and 502. FIG. 5 also illustrates a bifurcation 510, which may function as a reflection site (e.g., the same as or similar to reflection site 210 shown in FIG. 2). Providing an actuator on each side branch like this may enhance pumping of pumping system 200, for example.

In some embodiments, one or more actuators 204 (FIG. 1-FIG. 5) may set a stretching frequency to achieve a maximum pumping volume of the fluid based on wave characteristics in stretchable tube 202 including elasticity, frequency, locations of reflection sites, and/or other characteristics. Changing a length (see tube 100 in FIG. 1) of stretchable tube 202 may modify a reflection site and/or a pumping rate, for example. Changing an elasticity, a wall thickness, an inner radius, and/or other properties of stretchable tube 202 may modify a speed of wave propagation, the pumping rate, and/or other characteristics of pumping system 200.

Figure 6:
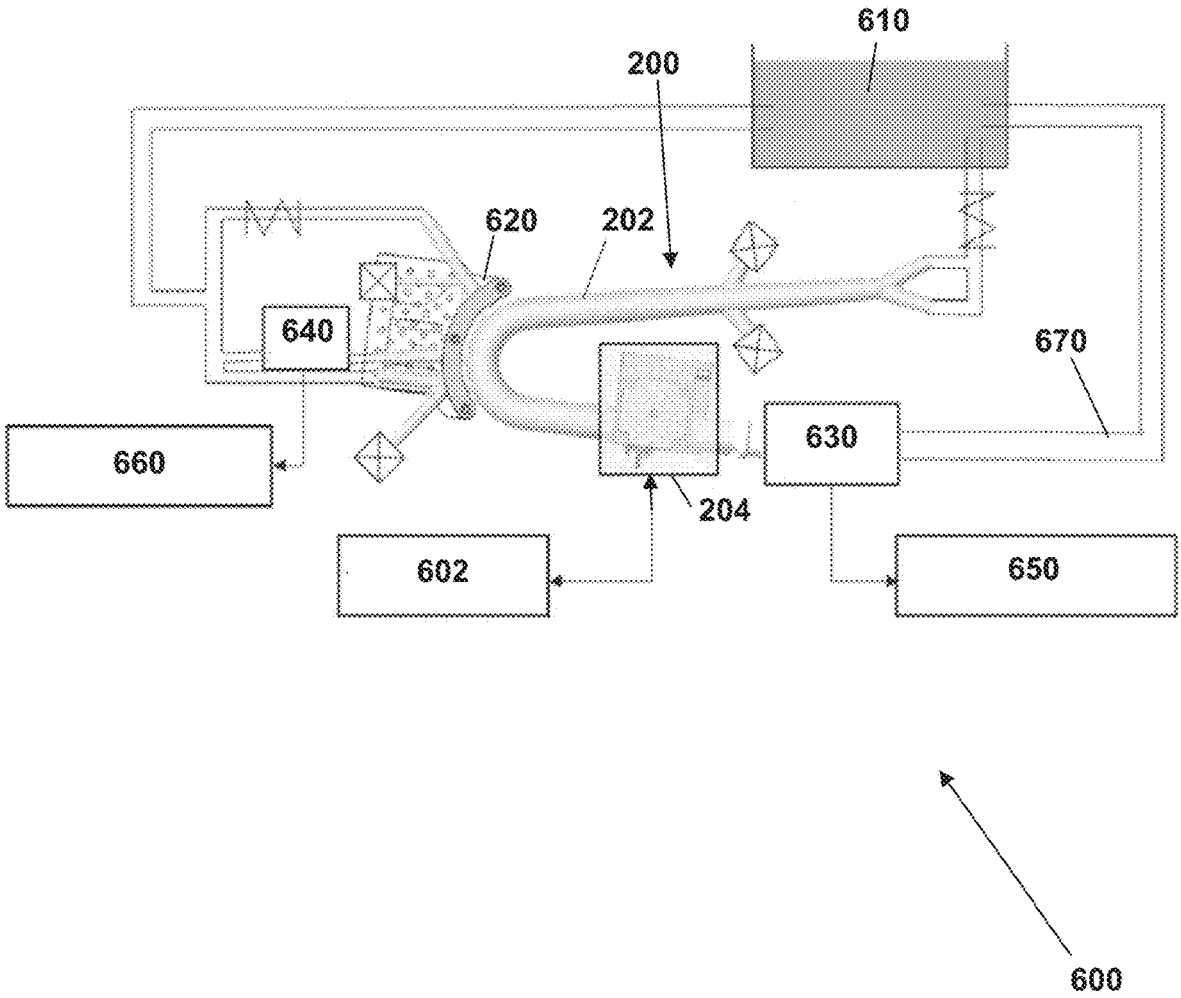
FIG. 6 illustrates a hydraulic circuit that includes the pumping system, in accordance with various embodiments.

In some embodiments, pumping system 200 is part of a hydraulic circuit. FIG. 6 illustrates a hydraulic circuit 600 that includes pumping system 200. Hydraulic circuit 600 includes a controller 602 (e.g., a computing system comprising one or more processors, etc.) coupled to actuator 204 configured to control actuator 204 to stretch and release stretchable tube 202. This may include controlling actuator 204 to stretch and release stretchable tube 202 at a specific frequency, with a specific magnitude, over a specific time (e.g., an oscillatory cycle), and/or with other controls. In some embodiments, hydraulic circuit 600 comprises a reservoir tank 610 configured to supply the fluid, a fixture 620 (e.g., various mechanical components such as a frame, structural support members, clips, clamps, anchors, bolts, etc.) configured to hold stretchable tube 202, actuator 204, and/or other components; one or more sensors 630 and 640 (e.g., flow meters, pressure sensors, temperature sensors, volume sensors, motion sensors, etc.) configured to generate one or more output signals conveying information related to stretching and releasing of stretchable tube 202 by actuator 204 and/or pumping by stretchable tube 202; one or more data recorders 650 and 660 (e.g., electronic data bases, etc.) configured to record the information in the one or more output signals, a flow path 670 (e.g., various tubes, pipes, etc.) for the fluid, and/or other components.

The hydraulic circuit 600 may provide a closed-loop flow circuit between an aortic phantom (which includes tube 202) and reservoir tank 610, for example. In this system, the aortic phantom may be installed into the system by placing luer lock-enabled barbed connectors on its major branches and coupling them with soft Tygon tubes that can be fitted to ports on side walls of this container. The ports of for carotid and femoral arteries are lumped with their respective branches and connected to the reservoir tank. The remaining branches may be isolated from circulation by placing stopcock valves downstream. The aortic root may be directly connected to a longitudinal stretching mechanism, and connected to the reservoir tank with a Tygon tube to complete the closed-loop circulation. The hydraulic circuit 600 may be filled with water, and visible air bubbles may be removed from the system. A pressure catheter may be relocated to the tube that connects the aortic stretcher to the reservoir, and the flow meter may be placed on top of this sensor. Upon this, a stepper motor may be used to start to actuate the stretching mechanism such that the system reaches an oscillatory steady state (e.g., ten cycles).

Controller 602 may be configured to coordinate the operation of the other components (e.g., ensuring synchronous stretching by multiple actuators) of any of the embodiments of the pumping system described above to provide the functionality described herein. Controller 602 may be formed by one or more processors, for example. In some embodiments, controller 602 may be configured to control different aspects of the functionality described herein based on different individual programming components (though these components are not specifically illustrated in FIG. 6). Controller 602 may be configured to direct the operation of components by software; hardware; firmware; some combination of software, hardware, or firmware; or other mechanisms for configuring processing capabilities. In some embodiments, controller 602 is executed in a single computing device, or in a plurality of computing devices in a datacenter, e.g., in a service oriented or micro-services architecture. In some embodiments, controller 602 may be coupled to other components of hydraulic circuit 600 by wires, and/or wirelessly (e.g., via one or more local networks and/or larger networks such as the internet). In some embodiments, controller 602 may comprise one or more portions separate from hydraulic circuit 600 (e.g., a separate stand alone computing system).

In some embodiments, a tangible, non-transitory, machine-readable medium storing instructions that when executed by controller 602 (e.g., a data processing apparatus) cause controller 602 to generate, execute, and/or otherwise provide an electronic computational model of the pumping system, and/or one or more operations of the above-mentioned process(es).

The computational model may be configured by controller 602 (and/or another computing device) such that, in the fluid domain, zero pressure is applied to the inlet and outlet, while an axisymmetric boundary condition is applied to an inner edge ($r=0$ as described above with respect to FIG. 1). At the interface of the fluid and solid domains, no slip boundary condition is applied (see Eqs. (5) and (6) above). In the solid domain, zero traction ($T_s=0$) is applied to the outer edge ($r_s=r_f+t_s$), and the inlet edge is extended cyclically using a custom hybrid boundary condition. One cycle of the boundary condition comprises a stretch and a recoil. During stretching, a prescribed velocity profile is applied to the wall (of an electronic model of stretchable tube 100 and/or stretchable tube 202 described above) to elongate the tube. The shape of the velocity waveform may be determined based on the root displacement measurements of an aorta, for example, using cardiovascular magnetic resonance as an example. Data may be adopted from their measurements and then a polynomial curve may be fitted on the measurements. For the beginning of the cycle, a linear profile is applied (e.g., since there may be no initial measurement data to use as a basis).

Figures 7, 8:
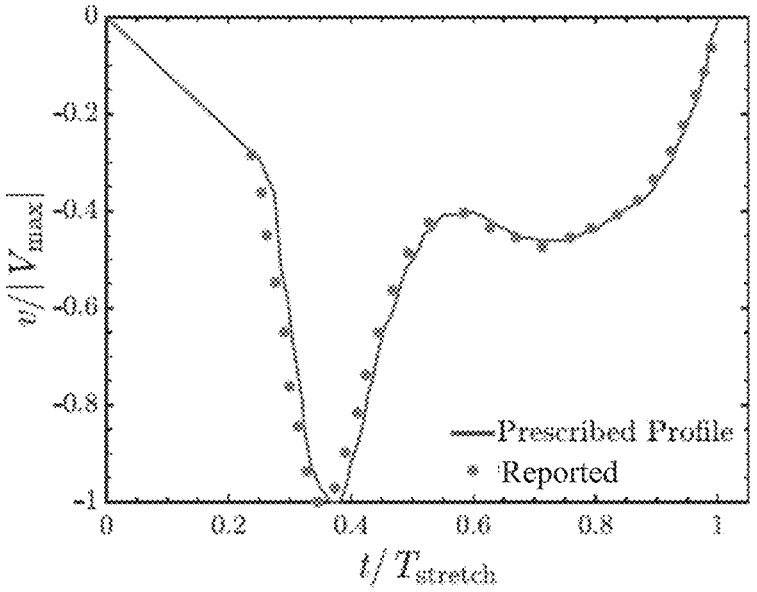
FIG. 7 illustrates a table, which lists example physical parameters that may be used by a computational model of the pumping system, in accordance with various embodiments.
FIG. 8 illustrates a boundary condition that may be implemented in the computational model at a tube (e.g., an electronic version of the stretchable tube shown in FIG. 1 and/or FIG. 2) root based on reported physiological measurements, in accordance with various embodiments.

FIG. 7 illustrates Table I, which lists example physical parameters that may be used by the computational model (or may be used for an embodiment of pumping system 200 described above). Table I lists possible examples of a (solid) wall thickness, a (solid) wall density, a Poisson ration for the (solid) wall, a fluid density, a fluid viscosity, and a fluid domain radius (i.e., the inner radius of stretchable tube 100 shown in FIG. 1). These physical parameters may be representative of a relevant physiological system, for example, and/or other physical systems. Note that these parameters are only examples, and the computational model may be generated, executed, and/or otherwise provided based on different parameters, and still function as described herein.

FIG. 8 illustrates a boundary condition that may be implemented in or for the computational model at the tube (e.g., an electronic version of stretchable tube 100 shown in FIG. 1 and/or stretchable tube 202 shown in FIG. 2) root based on reported physiological measurements. FIG. 8 illustrates a prescribed velocity profile applied to the root wall during the stretching phase overlaid on top of reported magnetic resonance measurements. A maximum amount of stretch may be determined by computing the area under the velocity-time curve and normalized by the length of the tube (stretching coefficient, SR). Recoil begins after peak displacement is reached when the prescribed velocity is replaced by a zero-traction boundary condition and the tube relaxes due to its own elasticity. The summation of the stretching and recoil phases completes one period. To control the length of the stretching phase, the duty cycle (DC) is defined, which is the ratio of the stretching time over the full cycle. DC may be ⅓, for example.

In some, the computation model may be and/or utilize a 2D axisymmetric model, comprising a fluid domain and a solid domain coupled at the inner edge of the tube wall (e.g., an electronic version of stretchable tube 100 shown in FIG. 1 and/or stretchable tube 202 shown in FIG. 2). For solving the fluid and solid domains numerically, a finite element method may be used. A fluid-structure interaction model may employ the Arbitrary Lagrangian-Eulerian method. This method uses a generalized explicit numerical formulation and captures the advantages of both Eulerian and Lagrangian methods for simulating large deformations. Therefore, this approach is advantageous for computationally modelling the wave pumping in the longitudinal impedance pump (e.g., pumping system 200 described above) with considerable stretch at the root of the tube.

Figure 20:
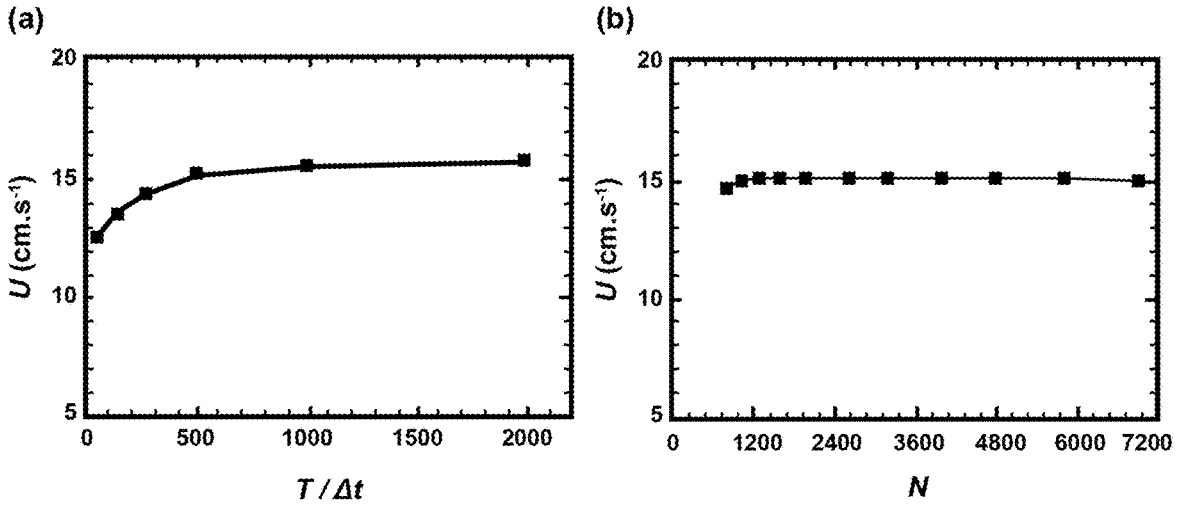
FIG. 20 illustrates first example results for spatial and temporal discretization-independence studies, in accordance with various embodiments.

Example inputs, algorithm (see the "Initialize" portion), and outputs of the computational model are summarized as a pseudocode in FIG. 9. FIG. 9 provides a description of a fluid-structure interaction algorithm for implementing the longitudinal wave pumping system (e.g., pumping system 200 described above) computational model. Outputs may include the fluid velocity [v (x, t)], fluid pressure [p (x, t)], and solid displacement [u (X, t)]. The (computational model of the pumping) system is initialized at rest, with zero pressure and velocity in the fluid, and zero stress and strain in the solid. The fluid and solid domains may comprise 1040 and 260 elements (e.g., from a mechanical independency investigation, which is shown in FIG. 20), respectively, and a time step may be 0.001 s, for example. The period of the cycle may be determined by f, and the relative durations of the stretching and recoil may be determined by duty cycle (DC, described above).

The computational model may be generated and/or solved (e.g., by controller 602 shown in FIG. 6 and or other computing systems) using a finite element solver as one example. Simulations may be run (e.g., again by controller 602 and/or other computing systems) on a standalone computing workstation equipped with an Intel Core i7 CPU (6 cores and 3201 MHz) with 32 GB memory, as an example (or this computer may be or form a part of controller 602).

Wave dynamics in an elastic tube depend on three primary parameters (though there may be others): (i) frequency of the wave generator, (ii) wave speed, and (iii) reflection sites (as described herein). The computational model is configured such that the natural frequency of the system (e.g., pumping system 200) is determined. In some embodiments, a free vibration test and/or a spectral analysis may be performed to identify the natural frequencies. To perform the free vibration test, the tube model (e.g., an electronic version of stretchable tube 100 shown in FIG. 1) is stretched using a step-function and immediately released, continuing until both fluid and solid motion end. The propagating waves are analyzed using their corresponding power spectra. In this analysis, the proportion of the total signal power contributed by each frequency component is determined from the discrete Fourier transform (via FFT). The squared amplitude, averaged by the number of samples, is determined for each frequency component. The relation between the natural frequency and the wave speed in a fluid-filled elastic tube can also be determined based on:

$$f_n = n\frac{c}{2L}, \tag{8}$$

where $f_n$ is the natural frequency of the system corresponding to the nth harmonic, c is the speed at which the waves propagate in the tube (wave speed), and L is the tube length. To determine the wave speed, the Moens-Korteweg equation may be utilized, given by:

$$c = \sqrt{\frac{E_s t_s}{2 r_f \rho_f}}, \tag{9}$$

where $E_s$ is the Young modulus of the wall, $t_s$ is the wall thickness, $r_f$ is the internal radius, and ρ is the fluid density. The natural frequencies determined using Eq. (8) may be compared to the ones from the computational model. Simulations may be run for different levels of tube stiffness, which may be quantified by the wave speed inside the tube [Eq. (9)]. At each wave speed, simulations may be performed for different frequencies (e.g., 0.5, 0.8, 1, 1.25, 1.6, 2, 2.5, 3.2, and 4 Hz as several examples). Simulations may also be run for different tube lengths. Ranges of the parameters employed in example simulations are shown in FIG. 10.

FIG. 10 illustrates Table II, which lists various example parameter settings for different possible pumping systems (e.g., pumping system 200 described above). The ranges of the various example parameter settings may be inspired by the human cardiovascular system, for example. In Table II, SR is defined as the stretch ratio which is the amplitude of the maximum stretch scaled by the initial tube length.

As a practical example, given representative baseline parameters (L=0.5 m, r=0.015 m, $E_s$=100 kPa, density of 1050 kg/m$^3$, and thickness of 0.1 cm), Eq. (9) yields c=1.78 m/s. Therefore, the first three expected natural frequencies for this embodiment of the computational model, determined by Eq. (8), are $f_1$=1.78 Hz. $f_2$=3.56 Hz, and $f_3$=5.34 Hz.

Figure 11:
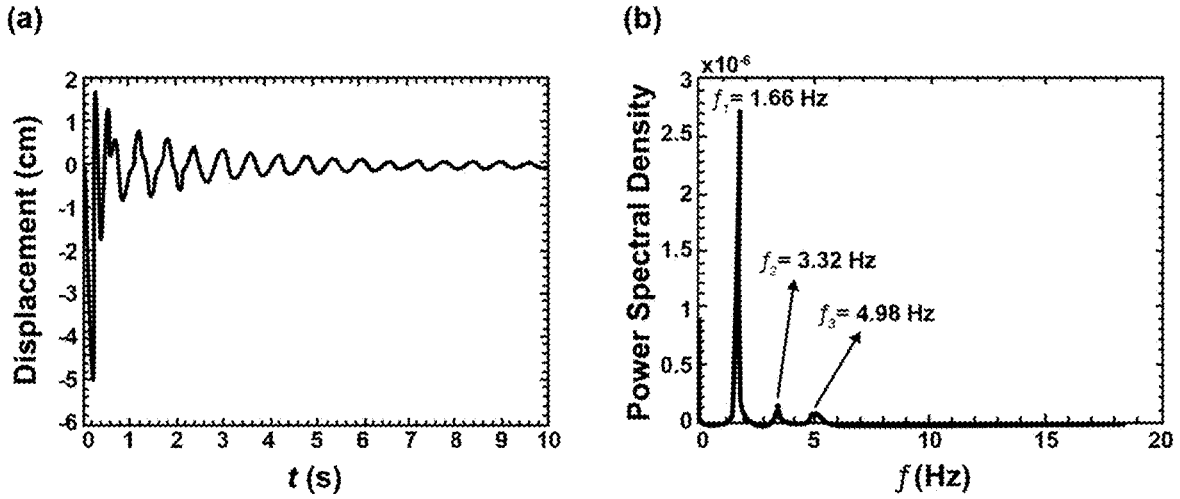
FIG. 11 shown an example modeled pumping system's response to impulse stretching, in accordance with various embodiments.

FIG. 11 shown this example modeled pumping system's response to impulse stretching. In graph (a) a transient response of a longitudinal component of the wall displacement is shown, and in graph (b) the power spectrum density of the outlet flow signal is shown. The peaks correspond to the natural frequencies of the modeled system. The corresponding theoretical values are 1.78, 3.56, and 5.34 Hz for the first three natural frequencies, respectively. More specifically, graph (a) shows the determined displacement of the root (inlet) for a free-vibration test with stretching coefficient of SR=0.1, which corresponds to 5-cm stretch for 50-cm tube length. The displacement of the root may be sampled for 10 s, beyond which the amplitude of the displacement is nearly zero. A Fast Fourier Transform (FFT) may be applied to identify the model's natural frequencies, as shown in graph (b). The determined natural frequencies match well with the theoretical values. This comparison shows that the employed fluid-structure interaction modeling is capable of capturing the wave dynamics accurately.

Figure 12:
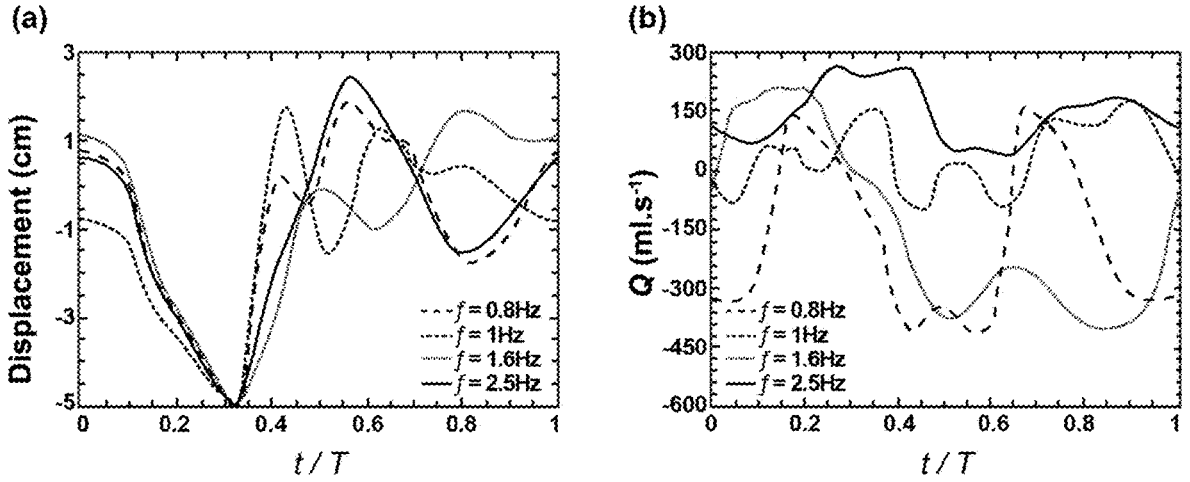
FIG. 12 illustrates sample displacement waveforms at a root and flow waveforms at the outlet of an example stretchable tube (e.g., the stretchable tube shown in FIG. 1, the stretchable tube shown in FIG. 2, or electronic representations thereof), in accordance with various embodiments.

FIG. 12 illustrates sample displacement waveforms at the root and flow waveforms at the outlet of an example stretchable tube (e.g., stretchable tube 100 shown in FIG. 1, stretchable tube 202 shown in FIG. 2, or electronic representations thereof). Graph (a) show tube root (inlet) displacement and graph (b) shows outlet flow at given different excitation frequencies. FIG. 12 illustrates the root displacement (graph (a)) and outlet flow profile (graph (b)) during one oscillatory steady-state period (T) at different frequencies. To determine the effect of the stretching frequency, the applied profile may be fixed to the tube root (FIG. 8) and the length of the cycle may be changed. By fixing the tube length and the wave speed, the relation between the outlet flow profile and the excitation frequency can be tracked. The displacement profile during the stretching phase is due to the applied boundary condition to the wall, and therefore, for different frequencies, it has a similar shape. As the recoil starts, the displacement-time variation exhibits the characteristics of a mass-spring system reacting to an initial force with an overshoot and subsequent oscillations. The exact response of the tube and the oscillation at the root varies across different frequencies. As the excitation happens, the waves are allowed to travel along the tube and are then partially reflected at the outlet interface. As the frequency changes, even for the same wave speed and tube length (fixed travel time), the interaction between the forward running waves and the reflected ones changes. In graph (b), outlet flow may be determined by integrating fluid velocity across the outlet elements (outlet elements refer to the output cross section of the tube where the tube is fixed). Similar to the displacement profile (shown in graph (a)), the flow profile (shown in graph (b)) varies dramatically across different frequencies in terms of both amplitude and direction.

Figure 13:
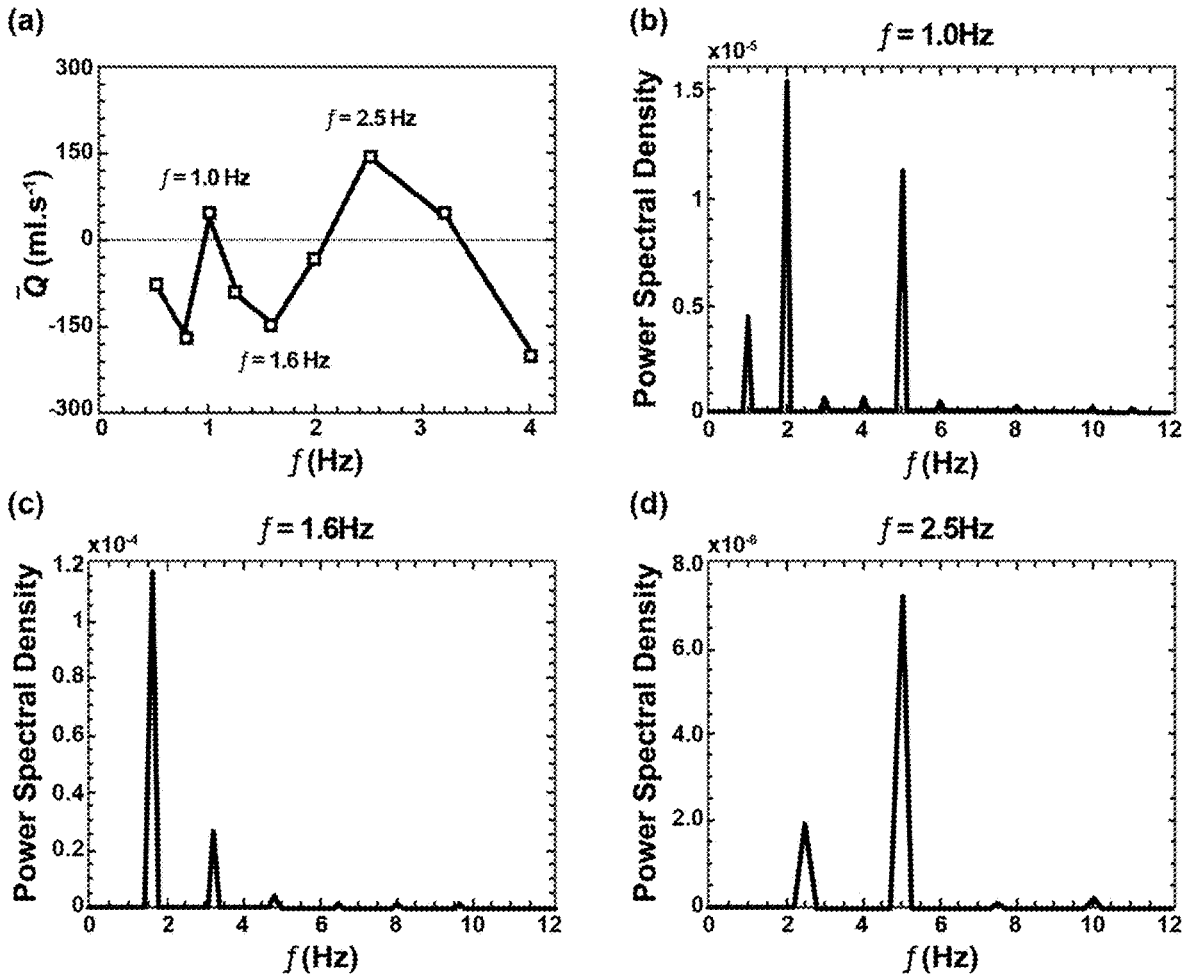
FIG. 13 illustrates an example mean flow-frequency analysis at baseline (computational) model parameters, in accordance with various embodiments.

FIG. 13 illustrates an example mean flow-frequency analysis at example baseline (computational) model parameters (e.g., described above). More specifically, FIG. 13 illustrates an example mean outlet flow $\overline{Q}$ obtained (e.g., by controller 602 shown in FIG. 6 and/or by using the computational model described herein) via averaging the flow (e.g., for stretchable tube 100 shown in FIG. 1, stretchable tube 202 shown in FIG. 2, or electronic representations thereof) over one period T as a function of frequency. In FIG. 13, graph (a) illustrates mean outlet flow of a longitudinal impedance pump ($\overline{Q}$)—e.g., pumping system 200 (and/or a modeled electronic version thereof) shown and described above—as a function of excitation frequency. FIG. 13 also shows the power spectral density of the outlet flow at the frequencies of (in graph (b)) 1 Hz. (in graph (c)) 1.6 Hz, and (in graph (d)) 2.5 Hz.

The mean flow-frequency data in FIG. 13 may be obtained at the given example baseline parameters for the model (L=0.5 m, r=0.015 m, $E_s$=100 kPa, density of 1050 kg/m$^3$, and thickness of 0.001 m). The mean outlet flow $\overline{Q}$ is an indicator of the bulk flow motion for the specific wave condition. Graph (a) in FIG. 13 suggests a non-linear mean flow-frequency relationship. The dominant negative flow (toward stretched and excited inlet) reported in graph (a) suggests a significant impact of the suction created during the stretching phase. However, there are certain frequencies which affect the flow direction and cause positive net flow generation (toward the fixed outlet). The frequency spectra of the oscillatory part of the outlet flow obtained by FFT at three sample frequencies, where the flow pattern changes, are plotted in graphs (b)-(d) in FIG. 13. For negative net flow (reverse pumping mode), the first harmonic is dominant, while for the positive cases (pumping mode), the second mode is dominant. The transition between the modes is due to the change in the wave state which is a result of wave propagation and reflection.

The net effect of the incident and reflected waves in a fluid-filled elastic tube is a function of the excitation frequency. The tube impedance (which is defined based on the pressure and flow harmonics) are minimized at certain frequencies close to the one-quarter wavelength frequency ($f_1=c/\lambda_1$ given $\lambda_1$=4 L) and three-quarter wavelength frequency ($f_2=c/\lambda_2$ given $\lambda_2$=4 L/3). In the present pumping system(s) (e.g., system 200 described above), the dependency of the generated flow profile on the applied frequency is due to the superposition of the propagating waves created due to the longitudinal stretch and reflected ones at the tube outlet. At certain frequencies (e.g., 1 or 2.5 Hz), the generated positive flow due to the interference of the traveling and reflected waves at the outlet dominate the negative flow generated by the suction (due to the stretch itself), and hence, the net flow is positive. In other words, these frequencies alter an existing trend in the longitudinal impedance pump, leading to a nonlinear mean flow-frequency relationship.

Conventional impedance pumps operate based on the pressure wave generation by the periodic tube wall excitation. For achieving the maximum pressure difference to generate flow, typically a system has to be excited close to its natural resonant frequencies. However, there are other systems that generate flow at frequencies far below the natural frequency. In any case, the unique frequency dependence of the net flow rate implies a wave-driven flow.

The computational model described herein indicates that there are two modes in the longitudinal impedance pump, the reverse pumping mode and the pumping mode. There is a mode transition between the reverse pumping and the pumping mode, where in the former one, the first harmonic corresponding to the stretching frequency is dominant, and in the latter one, the second harmonic is dominant (FIG. 13).

Figure 14:
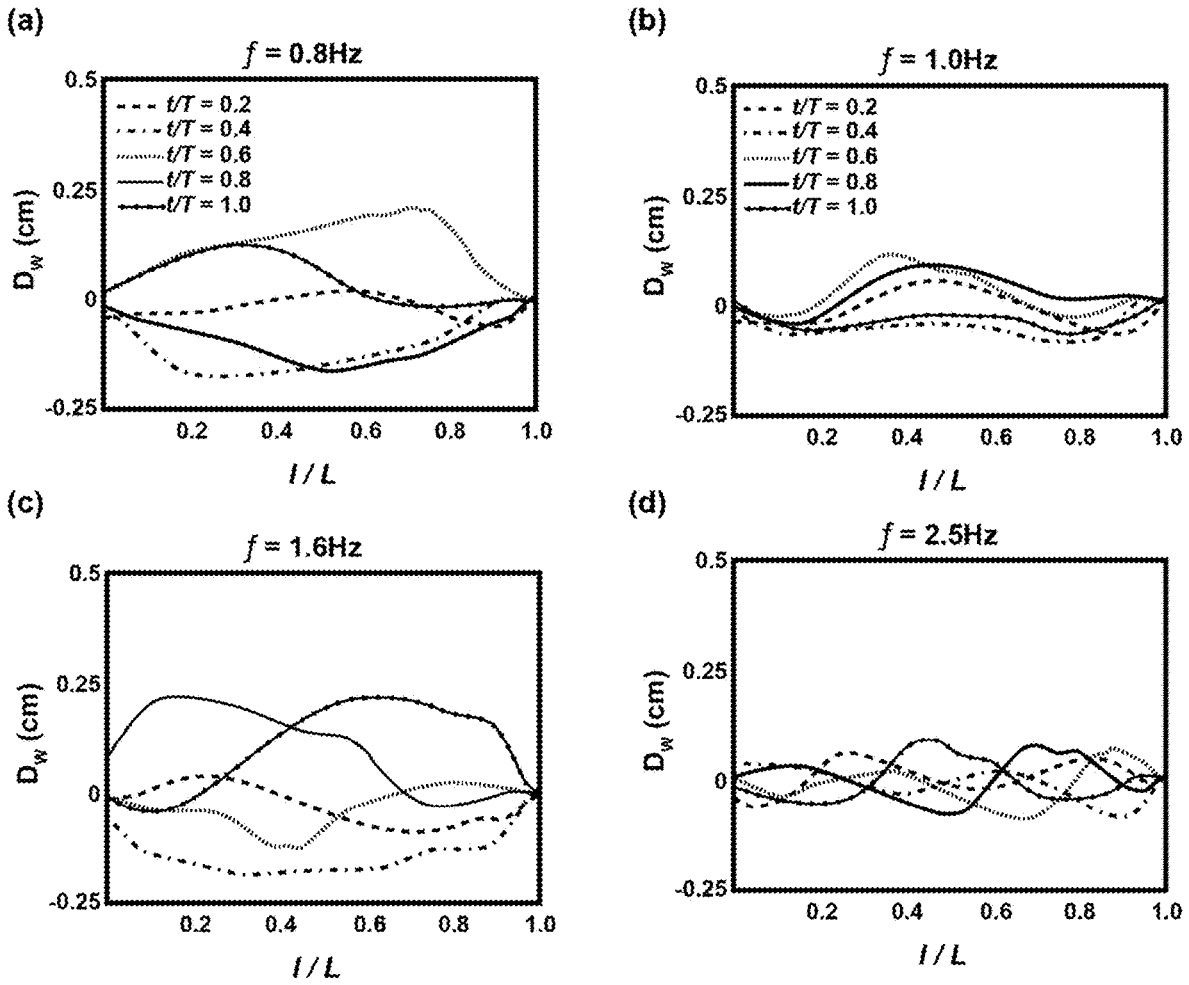
FIG. 14 illustrates radial displacement profiles of the tube wall (e.g., the stretchable tube shown in FIG. 1, the stretchable tube shown in FIG. 2, or electronic representations thereof) at given frequencies, in accordance with various embodiments.

FIG. 14 illustrates radial displacement profiles of the tube wall (e.g., the stretchable tube shown in FIG. 1, the stretchable tube shown in FIG. 2, or electronic representations thereof) at given frequencies. Computational model determined radial wall displacements ($D_w$) at different locations 1 along the tube length L at different snapshots in time for (graph (a)) f=0.8 Hz, (graph (b)) f=1.0 Hz. (graph (c)) f=1.6 Hz, and (graph (d)) f=2.5 Hz are illustrated. These graphs illustrate that there are two patterns for the wall displacement depending on the excitation frequency; the energetic mode which leads to the flapping motion at frequencies of 0.8 and 1.6 Hz (the first harmonic is dominant), and the ordinary mode which leads to the elastic oscillations at frequencies of 1.0 and 2.5 Hz (the second harmonic is dominant as shown in FIG. 13). The flapping motion is attributed to the large displacement in the tube wall (as shown in FIG. 14), while elastic oscillation is attributed to the smaller displacements. For the ordinary mode, it can be noticed that the interactions of the propagated and the reflected wave yield a lower amplitude wave on the tube wall. On the other hand, the amplitude of the tube wall displacement for the energetic mode is more significant.

Figure 15:
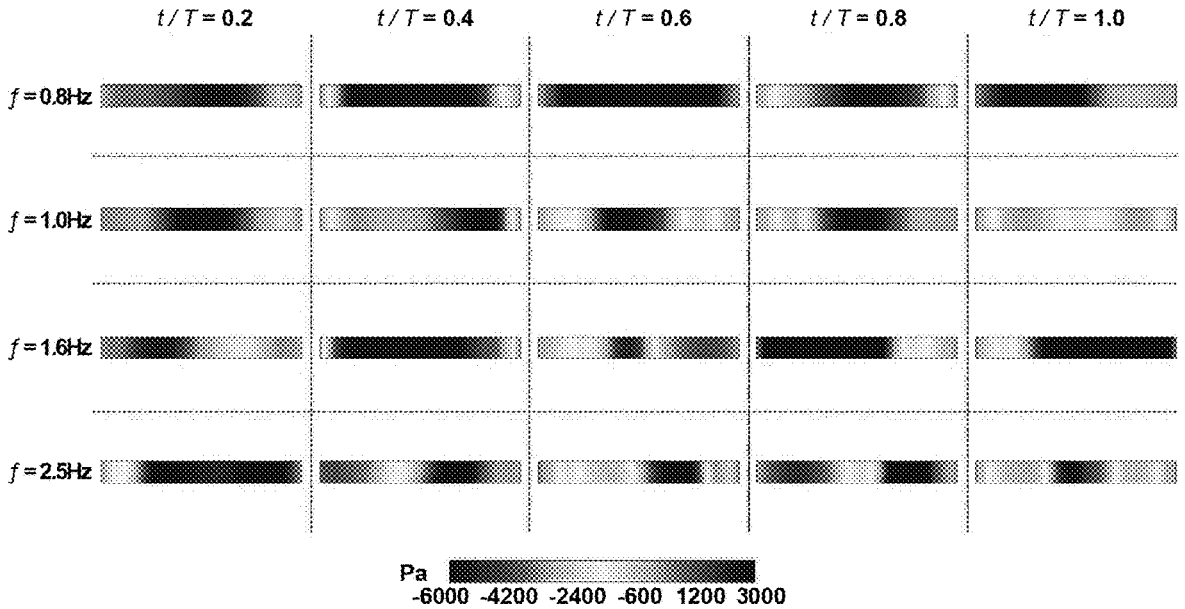
FIG. 15 illustrates distributions of the fluid pressure (e.g., in the stretchable tube shown in FIG. 1, the stretchable tube shown in FIG. 2, or electronic representations thereof) at various snapshots in time during one cycle, in accordance with various embodiments.

FIG. 15 illustrates distributions of the fluid pressure (e.g., in the stretchable tube shown in FIG. 1, the stretchable tube shown in FIG. 2, or electronic representations thereof) at various snapshots in time during one cycle. FIG. 15 illustrates spatial distributions of flow behavior in a longitudinal impedance pump (e.g., pumping system 200 described above, and/or an electronic model thereof comprising, provided by, and/or facilitated by the computational model described herein) at different snapshots of time during cycle T and for different frequencies. The plots in each row present pressure distributions. For visualization purposes, the deflection of the wall is neglected. The tube length is the baseline value of 0.5 m. The longitudinal impedance pump demonstrates both positive flow generation (pumping) and negative flow generation (reverse pumping) based on the stretching frequency. In the negative flow cases, as the pressure drops due to the stretching, a flow begins to fill the low-pressure region (stretched portion of the tube) from a higher-pressure region (resting portion of the tube). By modifying the stretching frequency and fixing the travel time (constant tube length and wave speed), a coordination between the propagated and reflected waves can be achieved such that net unidirectional flow is sustained. The stretching of the tube results in suction as demonstrated in FIG. 15. During recoil, the flow generation is determined primarily by the compression reflected pressure waves. The net pressure distribution inside the tube which ultimately determines the flow propagation is dictated by the initial suction due to the stretching and the wall displacement determined by the wave state. Depending on having either the energetic or ordinary mode, the response of the wall changes which consequently changes the pressure and flow distributions.

Figure 16:
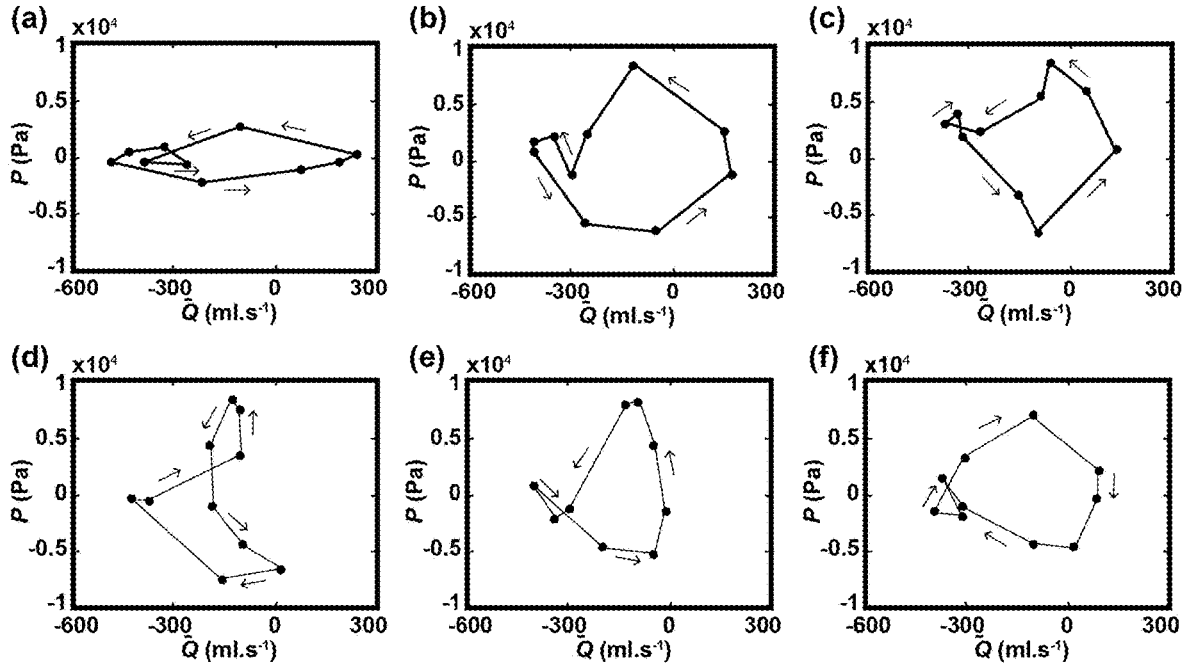
FIG. 16 illustrates the impact of the tube wall displacement on the pressure and flow relationship with pressure-flow (P-Q) loops at six locations along a tube (e.g., the stretchable tube shown in FIG. 1, the stretchable tube shown in FIG. 2, or electronic representations thereof) for an example stretching frequency, in accordance with various embodiments.

FIG. 16 illustrates the impact of the tube wall displacement on the pressure and flow relationship. FIG. 16 illustrates pressure-flow (P-Q) loops at six locations along a tube (e.g., the stretchable tube shown in FIG. 1, the stretchable tube shown in FIG. 2, or electronic representations thereof) for an example stretching frequency (of 1.6 Hz in FIG. 16). Arrows indicate the direction of the loop. The axial distance from the inlet (stretching site) are (graph (a)) z=2 cm, (graph (b)) Z=8 cm, (graph (c)) z=14 cm, (graph (d)) z=30 cm, (graph (c)) z=36 cm, and (graph (f)) z=42 cm. The P-Q loops are shown during oscillatory steady-state cycles at different locations along the tube. Loop direction tends to flip once along the length of the tube. Near the inlet where the stretching occurs, the clastic wall does work on the fluid, and the P-Q loop is, thus, counterclockwise. Closer to the outlet, the interaction of the suction and compression waves impedes flow, resulting in work done by the fluid on the walls and clockwise P-Q loop.

Figure 17:
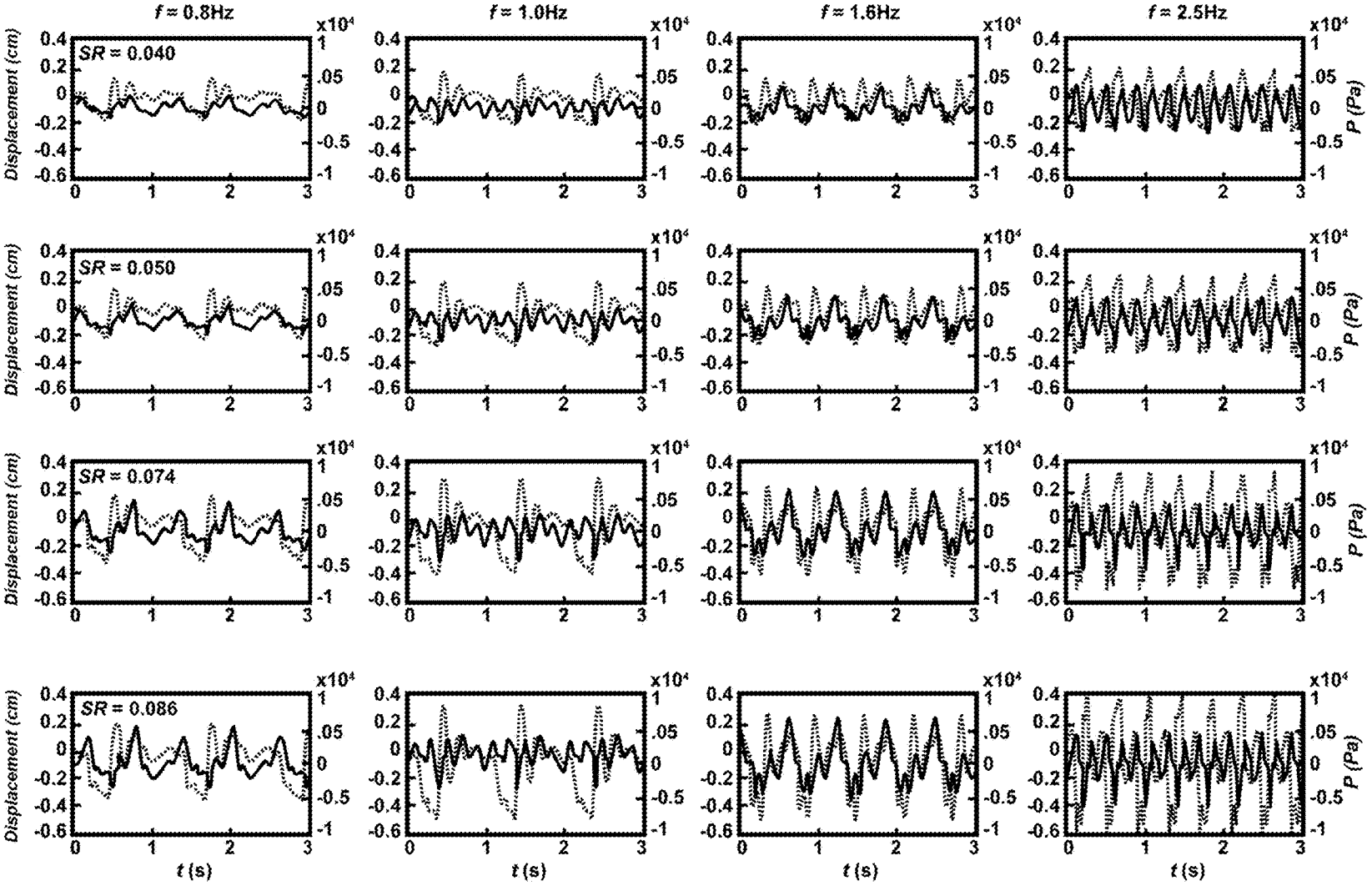
FIG. 17 illustrates example displacement and pressure waveforms determined 5 cm away from the outlet of an example stretchable tube (e.g., of the stretchable tube shown in FIG. 1, the stretchable tube shown in FIG. 2, or electronic representations thereof), in accordance with various embodiments.

FIG. 17 illustrates example displacement (dotted lines with a scale on the left side of each graph) and pressure waveforms (solid lines with a scale on the right side of each graph) determined 5 cm away (as one example reference point) from the outlet of an example stretchable tube (e.g., of the stretchable tube shown in FIG. 1, the stretchable tube shown in FIG. 2, or electronic representations thereof). If FIG. 17, t(s) represents time (in seconds). Data in each row of graphs is for a fixed stretching amplitude and in each column is for a fixed stretching frequency. FIG. 17 provided additional information about the underlying mechanism associated with longitudinal wave pumping, because the stretching amplitude is varied in this illustration. FIG. 17 shows that increasing the stretching amplitude elevates the pressure gradient at each fixed frequency. However, increasing the frequency alone at fixed stretching amplitude does not necessarily lead to the elevation in the pressure. For example, increasing the frequency from 0.8 to 1.0 Hz decreases the pressure amplification while further increase from 1.0 to 1.6 Hz leads to an increase in the pressure amplification. Similar non-linear dependency can also be observed in the displacement profile. The stretching amplitude is one of the major determinants of the input power to the longitudinal impedance pump. The elastic wall can be assumed as a spring where the displacement results in energy storage in the elastic wall elements. This input energy has linear relation with the stretch. Since the net-generated flow and the pressure gradient by the wave pumping mechanism are related to the power (or energy) carried by the waves, the stretching amplitude elevates the pressure gradient consistently. On the other hand, as shown in earlier figures, the effect of the frequency on the net generated flow (which is created due to the pressure gradient) is non-linear and depends on the mode of excitation (energetic mode vs ordinary mode).

Figure 18:
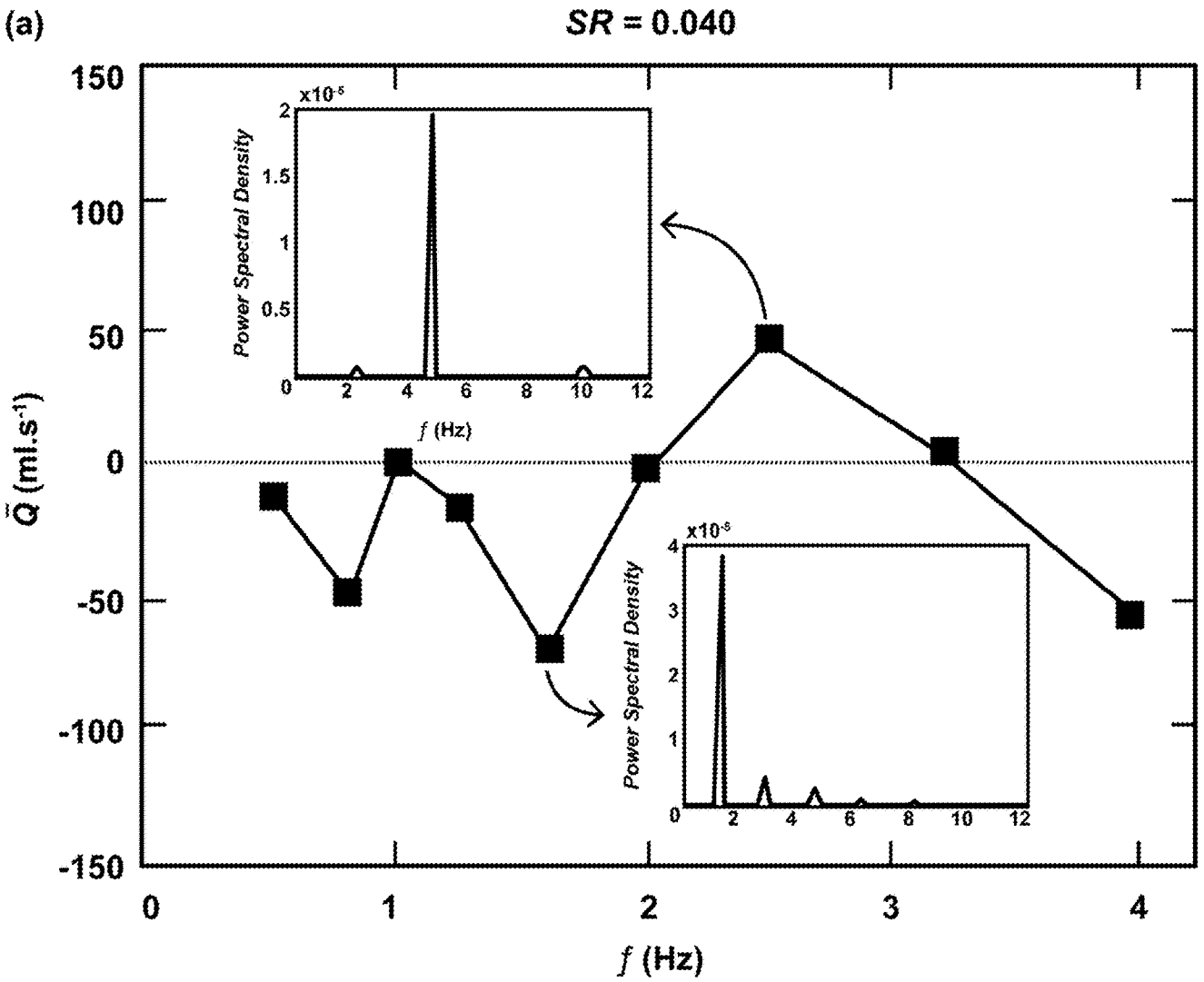
FIG. 18 illustrates mean flow-frequency at different levels of tube (e.g., the stretchable tube shown in FIG. 1, the stretchable tube shown in FIG. 2, or electronic representations thereof) root displacements, in accordance with various embodiments.
Figure 18:
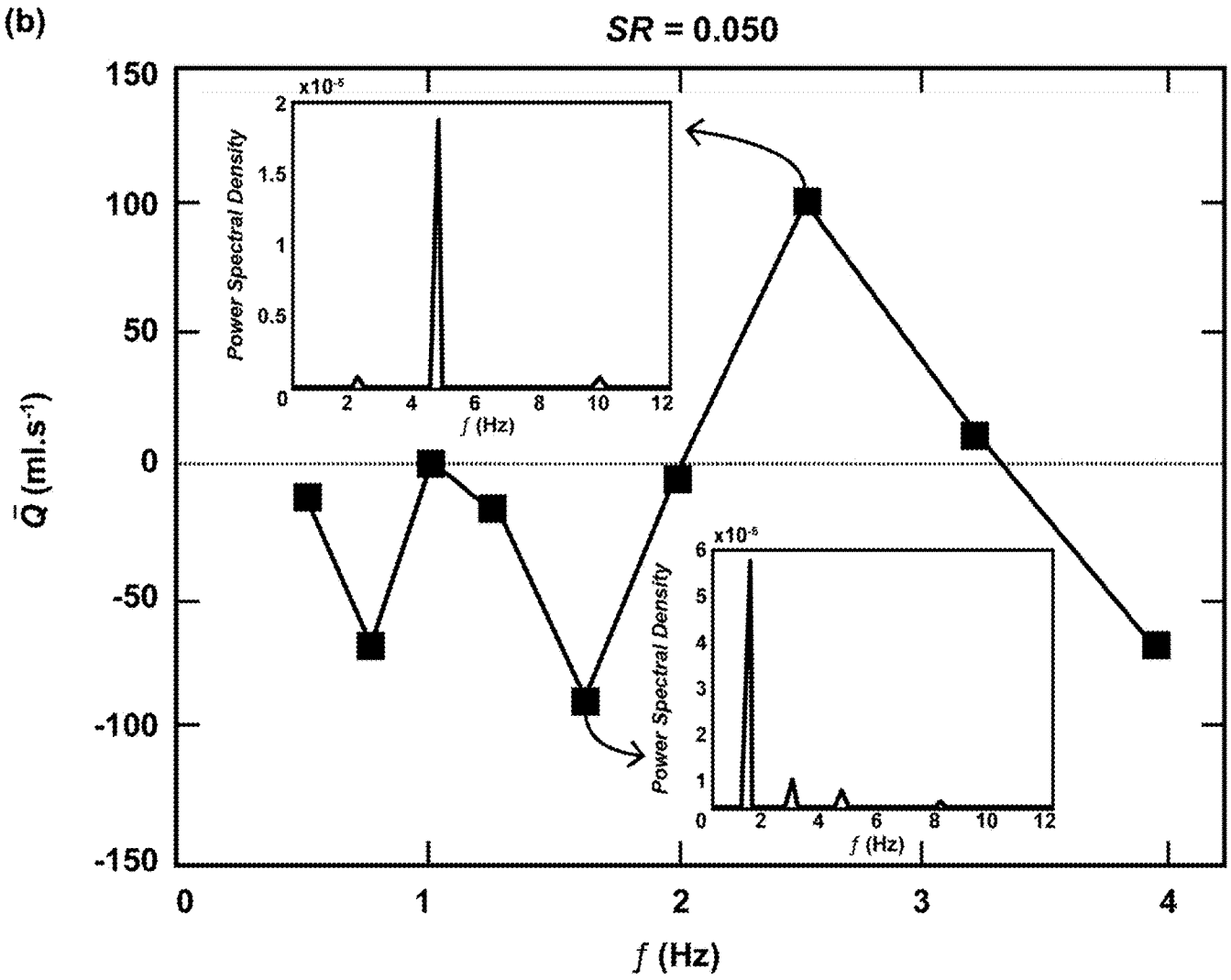
Figure 18:
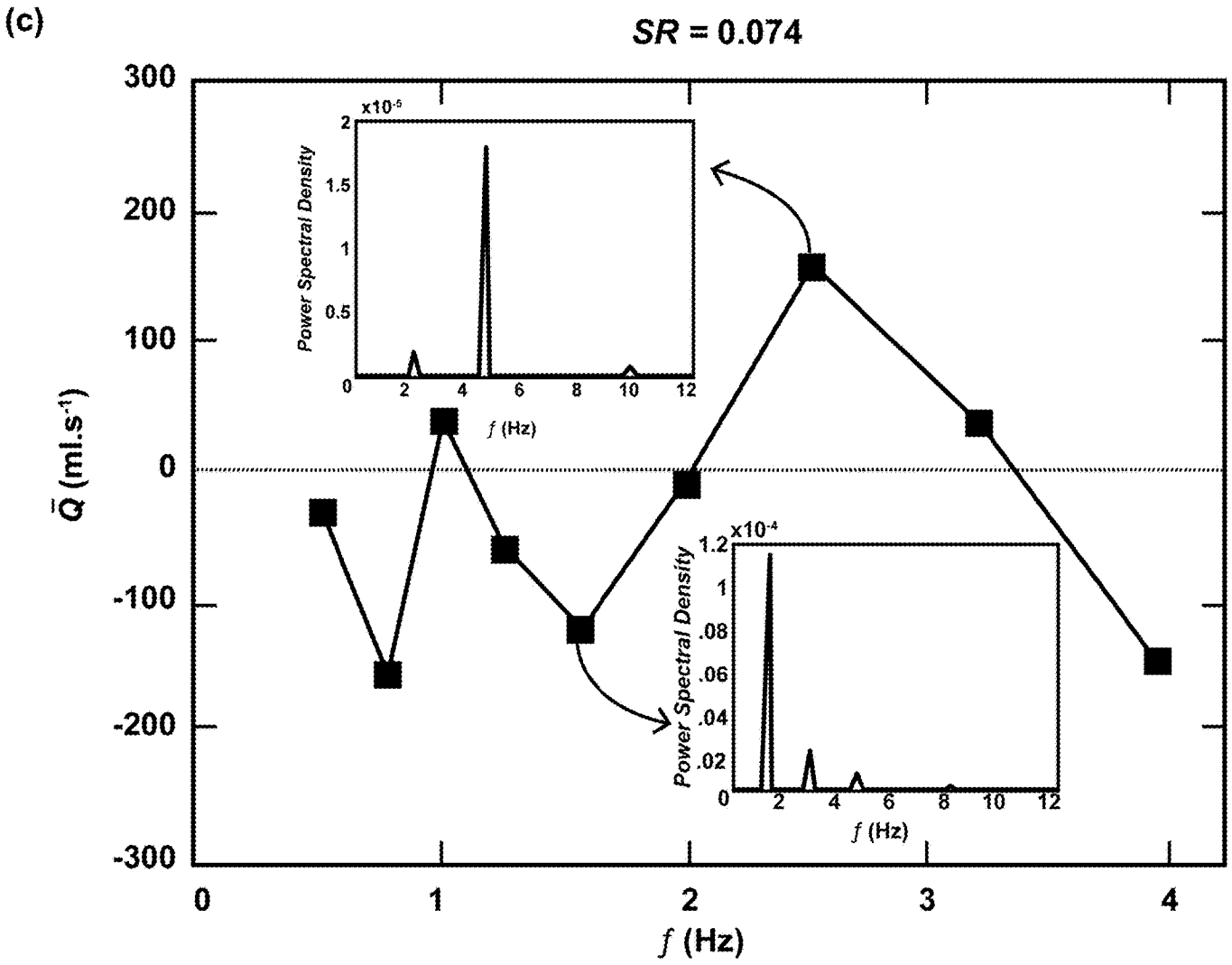
Figure 18:
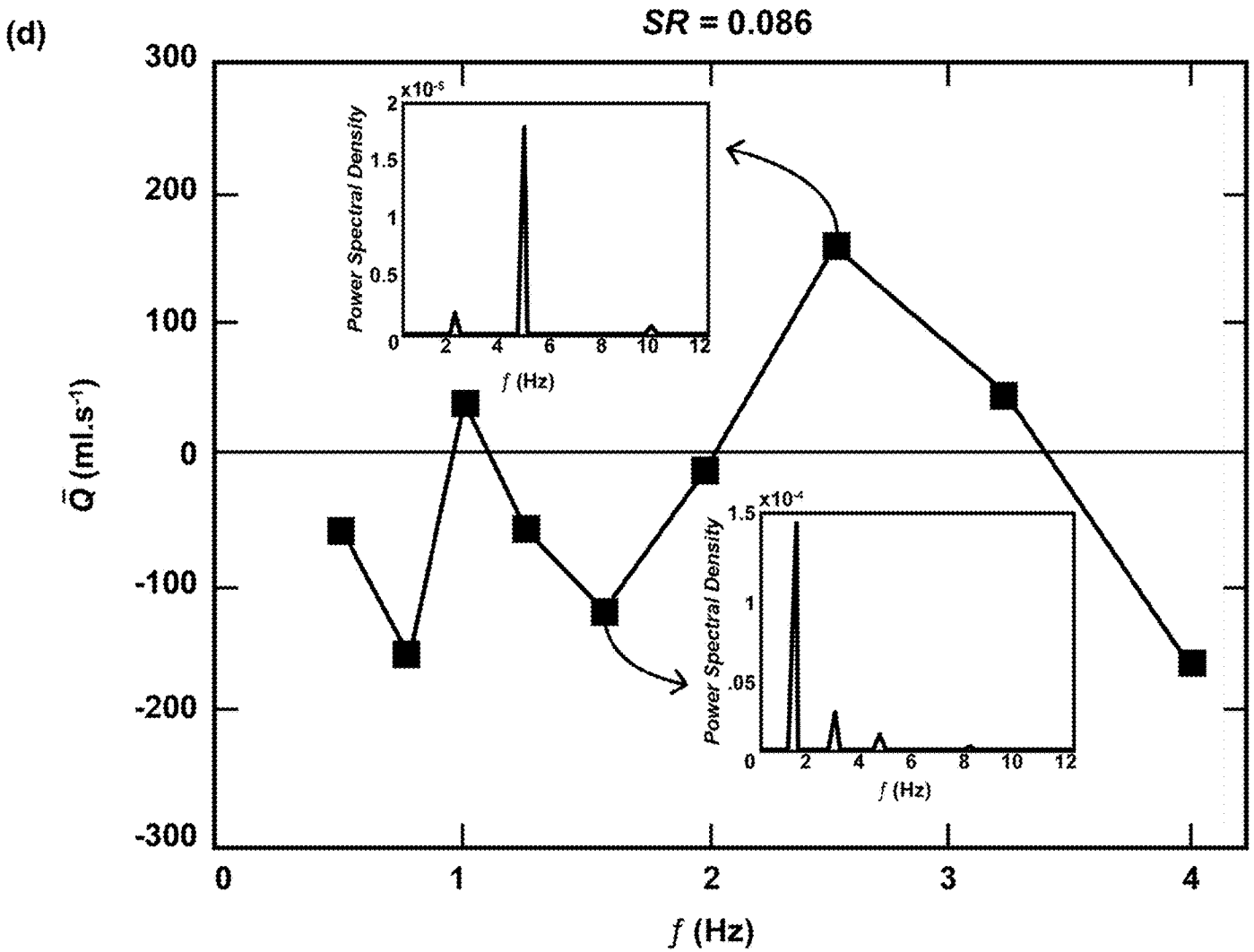

FIG. 18 illustrates mean flow-frequency at different levels of tube (e.g., the stretchable tube shown in FIG. 1, the stretchable tube shown in FIG. 2, or electronic representations thereof) root displacements. Mean outlet flow ($\overline{Q}$) of a longitudinal impedance pump (e.g., pumping system 200 described above and/or an electronically modeled version thereof) as a function of excitation frequency for stretching of (graph (a)) 2 cm corresponding to SR=0.04, (graph (b)) 2.5 cm corresponding to SR=0.05. (graph (c)) 3.7 cm corresponding to SR=0.074, and (graph (d)) 4.3 cm corresponding to SR=0.086 is shown. The power spectral density of the outlet flow at the frequencies corresponding to the peak flows is also demonstrated. The power spectra for the outlet flow at the local positive and negative peaks for various cases are also demonstrated in these graphs. FIG. 18 shows that the second harmonic is dominant for the pumping mode, while the first harmonic is dominant in the reverse pumping mode. The transition in the dominant mode in the flow waveform yields a resonance-like behavior in the mean flow-frequency pattern, where the initial negative value for the flow (which is due to the stretching-based suction at the inlet) varies to the positive values. At the given stretching amplitude, the positive flow pumping is due to the wave dynamics on the wall in its ordinary mode which leads to the elastic oscillations. Also, the amplitude of the stretch does not change this pattern and only affects the generated flow amplitudes.

Figure 19:
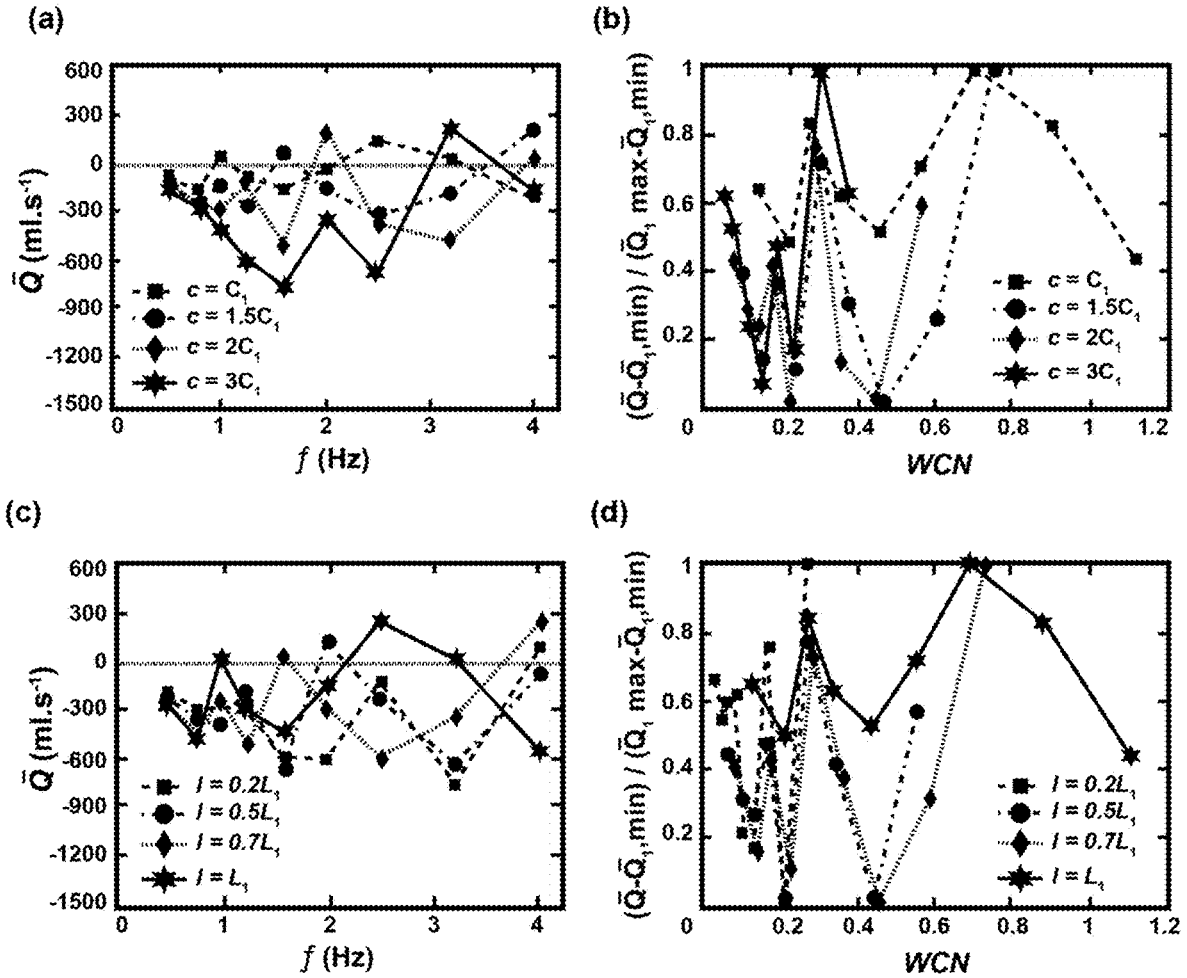
FIG. 19 illustrates the impact of tube stiffness and length (e.g., of the stretchable tube shown in FIG. 1, the stretchable tube shown in FIG. 2, or electronic representations thereof) on the generated flow in the longitudinal impedance pump (e.g., the pump shown in FIG. 2 and/or an electronic version thereof), in accordance with various embodiments.

FIG. 19 illustrates the impact of tube stiffness and length (e.g., of the stretchable tube shown in FIG. 1, the stretchable tube shown in FIG. 2, or electronic representations thereof) on the generated flow in the longitudinal impedance pump (e.g., pumping system 200 shown in FIG. 2 and/or an electronic version thereof). In FIG. 19, graph (a) illustrates mean outlet flow ($\overline{Q}$) of the longitudinal impedance pump against the excitation frequency for different levels of wave speed c. Graph (b) illustrates the normalized outlet flow of the longitudinal impedance pump against the wave condition number (WCN) for different levels of wave speed c. Graph (c) illustrates the mean outlet flow as a function of excitation frequency for different tube lengths. Graph (d) illustrates a normalized outlet flow as a function of wave condition number (WCN) for different tube length. FIG. 19 assumes a stretching ratio of 0.1 (as one possible example of many stretching ratios).

Graph (a) in FIG. 19 illustrates ($\overline{Q}$) as a function of frequency for different tube stiffness (measured by wave speed). Graph (a) illustrates four different example wave speeds, starting from C1, corresponding to the baseline parameters of the model described above (r=0.015 m, E=100 kPa, and thickness of 0.001 m). The tube radius and wall thickness remain constant, and only the wall elasticity is changed to alter the wave speed. As shown, changing the tube characteristics strongly affects the net flow generation in longitudinal impedance pump. Alteration of the wave speed affects the wave travel time and consequently changes the interactions of the propagated and reflected waves. As described earlier, the flow generation in the longitudinal impedance pump is the result of the net effect of the stretching suction and the compression waves. The alteration in the material characteristics and wave speed affects the intensity of the compression waves and, hence, results in a different mean flow-frequency pattern as shown earlier. At some frequencies (e.g., 3.2 Hz), for the same stretching amplitude, the flow can be either positive or negative depending on the wave speed inside the tube.

A mean flow-frequency relation as a function of the wave speed is shown using a dimensionless wave condition number (WCN) in graph (b) of FIG. 19. This helps illustrate the behavior of the longitudinal impedance pump (e.g., pumping system 200 shown and described above, and/or an electronic version thereof) across different ranges of parameters. WCN is a quantity that determines the state of wave dynamics in an elastic tube (computed by $WCN=f_L/c^{32}$). Results at different wave speeds collapse on top of each other and the non-linearity in mean flow-frequency pattern is well-captured using WCN.

Graph (c) of FIG. 19 illustrates mean outlet flow ($\overline{Q}$) for SR=0.1 as a function of frequency for different tube lengths. Varying the tube length changes the location of the reflection site in—e.g., the end of the tube as one example. This affects the wave interaction. Graph (c) illustrates example data for four lengths, starting from $L_1$=50 cm. As the wave state changes due to the alteration in the tube length, the net effect of the suction and compression waves changes, and therefore, the peaks in the mean flow-frequency pattern shift.

Graph (d) of FIG. 19 illustrates the normalized outlet flow at each tube length as a function of WCN.

Figure 21:
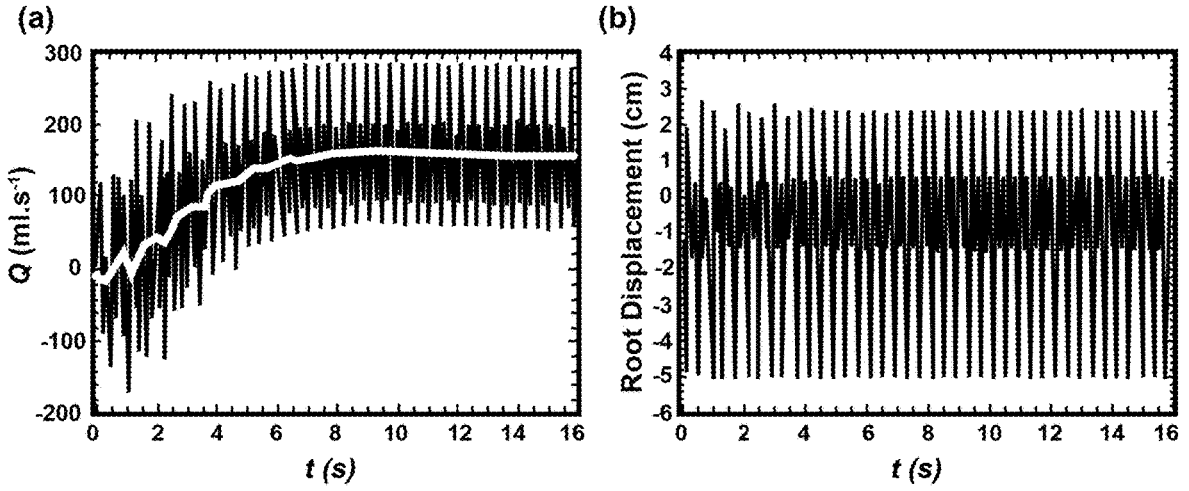
FIG. 21 illustrates second example results for the spatial and temporal discretization-independence studies, in accordance with various embodiments.

FIGS. 20 and 21 illustrate example results for spatial and temporal discretization-independence studies. Note that these numbers were obtained for a tube length, L=50 cm. To ensure independence of the results from temporal and spatial discretization, a time step Δt and total number of elements in temporal and spatial domains N (total number of computational elements that construct the electronic (computational) version of the tube) of a case were varied while keeping all other parameters unchanged. First, the same computation was performed with different time steps while keeping N at 4000 elements. The time step was increased or decreased by a factor of 2, starting at $\Delta t=1/500\ f$. The time step convergence criterion was defined at less than 3% change in outlet longitudinal velocity given a factor of two decrease in Δt. The largest time step satisfying this criterion, $\Delta t=1/1000\ f$, was selected. In order to consider different period lengths, the time step is a function of the stretching frequency. While keeping the time step at $\Delta t=1/1000\ f$, N was incremented by +/−20%, rounded to the nearest hundred and starting at N=4000. The number of the elements was maintained at 40 (fluid domain) and 10 (solid domain) along the radial direction such that changing N only changed the number of elements in the longitudinal direction (which was the same for both domains). The spatial convergence criterion was defined as less than 3% change in outlet longitudinal velocity given a 20% change in N. The results of the study are summarized in FIG. 20 for the case with parameters of $f$=1 Hz and SR=0.1. FIG. 20 illustrates different test cases for examining the associated error in the control parameter (the outlet axial velocity) for various (graph (a)) time steps and (graph (b)) spatial mesh. In FIG. 21, graph (a) illustrates a typical transient response of the mean outlet flow. The central line is a moving average over one cycle. Graph (b) in FIG. 21 illustrates a typical pattern for the root displacement comprising the active stretching and the passive recoil described herein.

The fluid-filled elastic tube system (e.g., pumping system 200, stretchable tube 202, stretchable tube 100, and/or electronic versions thereof, as described above) began at rest in each study simulation and then was excited until an oscillatory steady state was achieved. To track the periodicity of the fluid motion, mean outlet flow was determined by integrating the fluid velocity across the outlet elements over the duration of one period T. The oscillatory steady state criterion was defined as less than 1% change in mean outlet flow compared to the previous cycle. This was typically achieved within 35 cycles. A sample transient response of flow rate is shown in graph (a) of FIG. 21 for case parameters $f$=2.5 Hz, elasticity of 100 KPa, and SR=0.1. There was a transitional stage for the flow to build up before reaching its steady-state mean. Graph (b) of FIG. 21 illustrates the tube root elongation for the same case.

Figure 22:
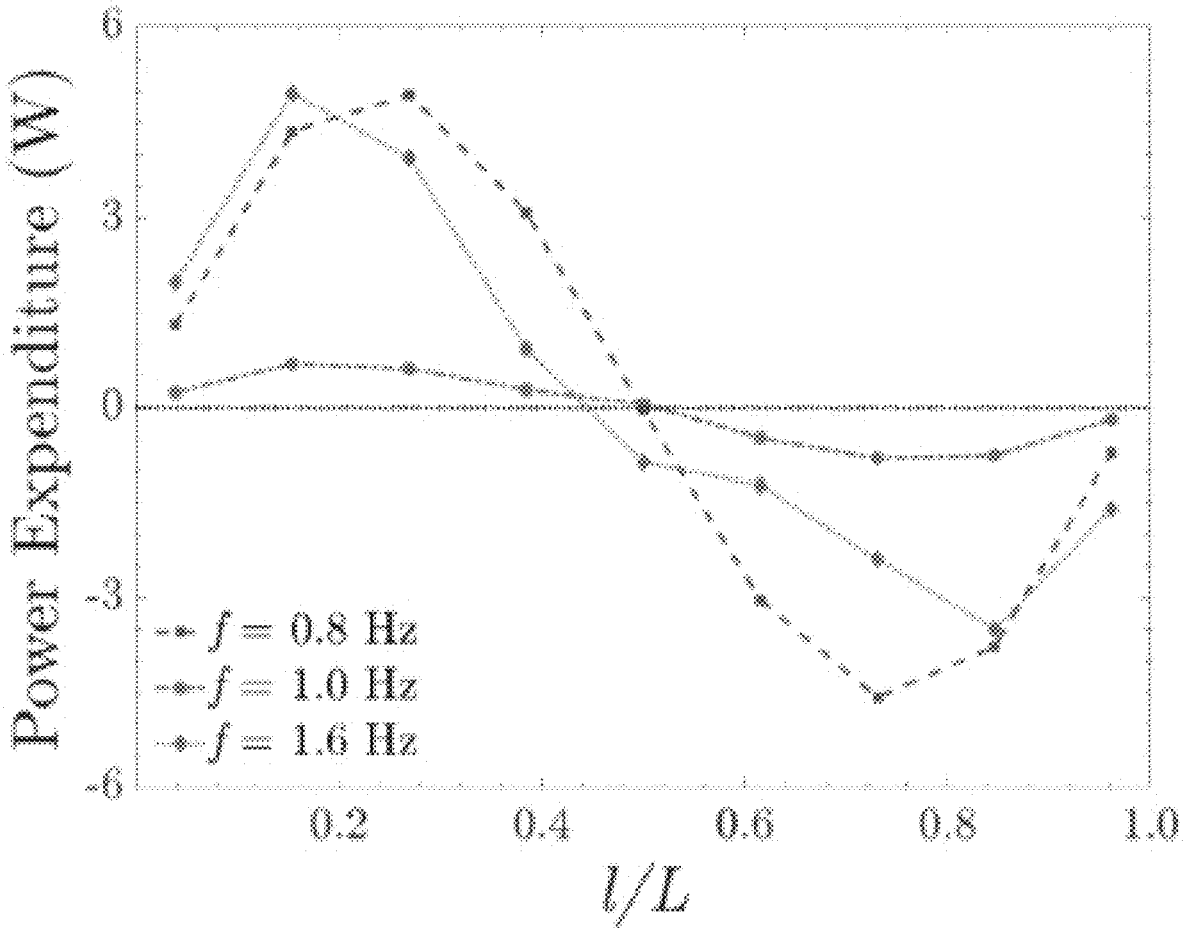
FIG. 22 illustrates power expenditure, determined from pressure-flow (P-Q) loop areas (shown in FIG. 16), at different locations along a tube for three frequencies, in accordance with various embodiments.

FIG. 22 illustrates power expenditure, determined from the pressure-flow (P-Q) loop areas (shown in FIG. 16), at different locations along a tube for three frequencies. The length of the tube is a baseline value of 0.5 m, for example. Negative areas indicate conversion of fluid energy to clastic energy, and positive areas indicate elastic energy converted to fluid energy. For each case, the loop area changes sign between the inlet (stretching zone) and outlet (reflection site). The magnitude of energy exchange along the tube is larger at the frequencies leading to the energetic mode (0.8 and 1.6 Hz) compared with the frequency corresponds to the ordinary mode (1.0 Hz). These results are obtained for the baseline tube length of 0.5 m.

In some embodiments, controller 602 (e.g., shown in FIG. 6 and described above) is configured to generate, execute, and/or otherwise provide the computational model based on a request received from an external computing device in communication with controller 602 (e.g., a mobile user device, a desktop user device, other client device(s), a server, etc.). In some embodiments, controller 602 is configured to provide the computational model to an external device (e.g., a mobile user device, a desktop user device, other client device(s), a server, etc.) configured to execute the computational model. It should be noted that in some embodiments, controller 602 may be configured such that in the above mentioned operations, input from users and/or sources of information inside or outside the present system(s) may be processed by controller 602 through a variety of formats, including clicks, touches, uploads, downloads, etc. The functionality provided by controller 602 may be provided by software or hardware modules that are differently organized than is presently described, for example such software or hardware may be intermingled, broken up, distributed (e.g. within a data center or geographically), or otherwise differently organized. The functionality described herein may be provided by one or more processors of one or more computers executing code stored on a tangible, non-transitory, machine readable medium.

Figure 23:
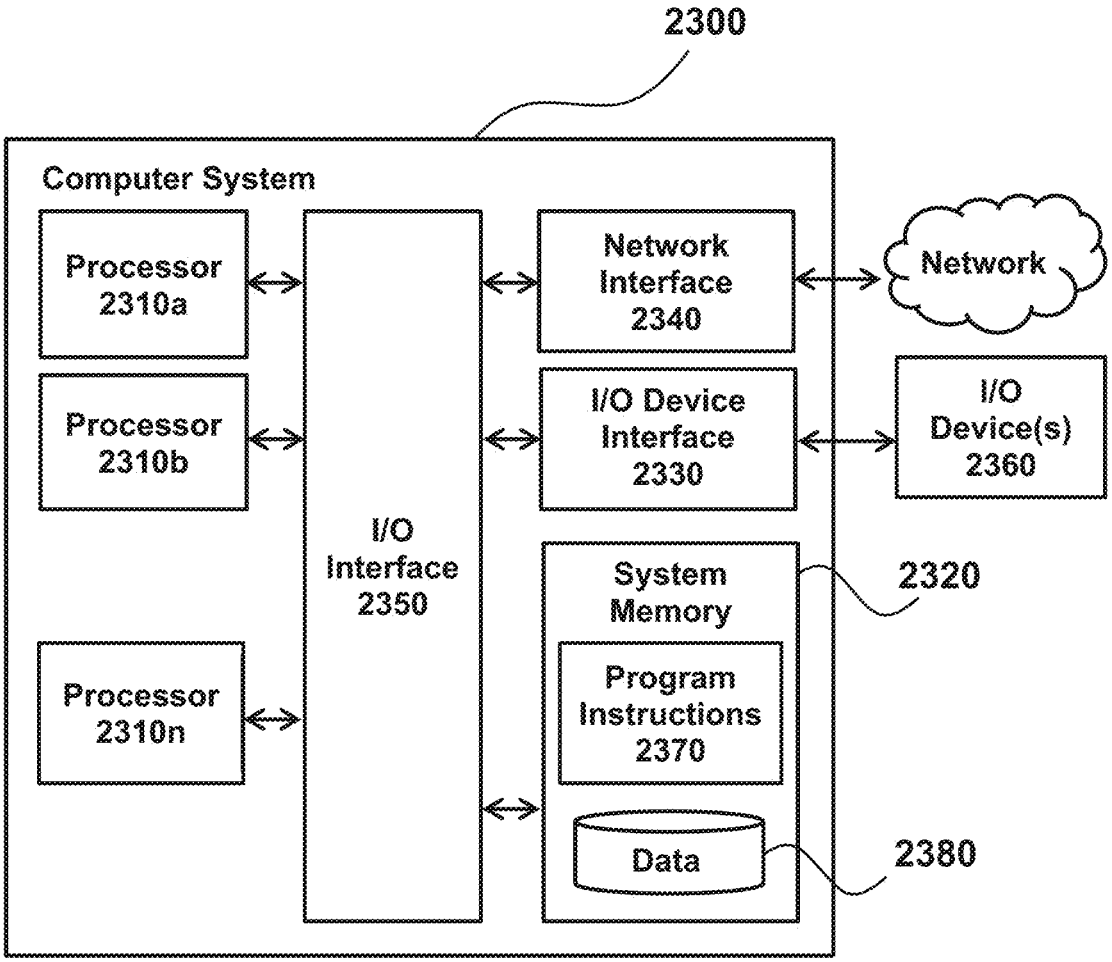
FIG. 23 is a diagram that illustrates an exemplary computing system, in accordance with various embodiments.

FIG. 23 is a diagram that illustrates an exemplary computer system 2300 in accordance with embodiments of the present system. Various portions of systems and methods described herein may include or be executed on one or more computer systems the same as or similar to computer system 2300. For example, controller 602 (FIG. 6) may be and/or include one more computer systems the same as or similar to computer system 2300. In addition, the electronic (e.g., computational) model described above may be generated, executed, and/or otherwise provided by computer system 2300 (e.g., by controller 602). Further, processes, modules, processor components, and/or other components of system 200 (FIG. 2) and/or hydraulic circuit 600 described herein may be executed by one or more processing systems similar to and/or the same as that of computer system 2300.

Computer system 2300 may include one or more processors (e.g., processors 2310*a*-2310*n*) coupled to system memory 2320, an input/output I/O device interface 2330, and a network interface 2340 via an input/output (I/O) interface 2350. A processor may include a single processor or a plurality of processors (e.g., distributed processors). A processor may be any suitable processor capable of executing or otherwise performing instructions. A processor may include a central processing unit (CPU) that carries out program instructions to perform the arithmetical, logical, and input/output operations of computer system 2300. A processor may execute code (e.g., processor firmware, a protocol stack, a database management system, an operating system, or a combination thereof) that creates an execution environment for program instructions. A processor may include a programmable processor. A processor may include general or special purpose microprocessors. A processor may receive instructions and data from a memory (e.g., system memory 2320). Computer system 2300 may be a uni-processor system including one processor (e.g., processor 2310*a*), or a multi-processor system including any number of suitable processors (e.g., 2310*a*-2310*n*). Multiple processors may be employed to provide for parallel or sequential execution of one or more portions of the techniques described herein. Processes, such as logic flows, described herein may be performed by one or more programmable processors executing one or more computer programs to perform functions by operating on input data and generating corresponding output. Processes described herein may be performed by, and apparatus can also be implemented as, special purpose logic circuitry, e.g., an FPGA (field programmable gate array) or an ASIC (application specific integrated circuit). Computer system 2300 may include a plurality of computing devices (e.g., distributed computer systems) to implement various processing functions.

I/O device interface 2330 may provide an interface for connection of one or more I/O devices 2360 to computer system 900. I/O devices may include devices that receive input (e.g., from a user) or output information (e.g., to a user). I/O devices 2360 may include, for example, graphical user interface presented on displays (e.g., a cathode ray tube (CRT) or liquid crystal display (LCD) monitor), pointing devices (e.g., a computer mouse or trackball), keyboards, keypads, touchpads, scanning devices, voice recognition devices, gesture recognition devices, printers, audio speakers, microphones, cameras, or the like. I/O devices 2360 may be connected to computer system 2300 through a wired or wireless connection. I/O devices 2360 may be connected to computer system 2300 from a remote location. I/O devices 2360 located on a remote computer system, for example, may be connected to computer system 900 via a network and network interface 2340.

Network interface 2340 may include a network adapter that provides for connection of computer system 2300 to a network. Network interface may 2340 may facilitate data exchange between computer system 2300 and other devices connected to the network. Network interface 2340 may support wired or wireless communication. The network may include an electronic communication network, such as the Internet, a local area network (LAN), a wide area network (WAN), a cellular communications network, or the like.

System memory 2320 may be configured to store program instructions 2370 or data 2380. Program instructions 2370 may be executable by a processor (e.g., one or more of processors 2310*a*-2310*n*) to implement one or more embodiments of the present techniques. Instructions 2370 may include modules and/or components of computer program instructions for implementing one or more techniques described herein with regard to various processing modules and/or components. Program instructions may include a computer program (which in certain forms is known as a program, software, software application, script, or code). A computer program may be written in a programming language, including compiled or interpreted languages, or declarative or procedural languages. A computer program may include a unit suitable for use in a computing environment, including as a stand-alone program, a module, a component, or a subroutine. A computer program may or may not correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one or more computer processors located locally at one site or distributed across multiple remote sites and interconnected by a communication network.

System memory 2320 may include a tangible program carrier having program instructions stored thereon. A tangible program carrier may include a non-transitory computer readable storage medium. A non-transitory computer readable storage medium may include a machine readable storage device, a machine readable storage substrate, a memory device, or any combination thereof. Non-transitory computer readable storage medium may include non-volatile memory (e.g., flash memory, ROM, PROM, EPROM, EEPROM memory), volatile memory (e.g., random access memory (RAM), static random access memory (SRAM), synchronous dynamic RAM (SDRAM)), bulk storage memory (e.g., CD-ROM and/or DVD-ROM, hard-drives), or the like. System memory 2320 may include a non-transitory computer readable storage medium that may have program instructions stored thereon that are executable by a computer processor (e.g., one or more of processors 2310*a*-2310*n*) to cause the subject matter and the functional operations described herein. A memory (e.g., system memory 2320) may include a single memory device and/or a plurality of memory devices (e.g., distributed memory devices). Instructions or other program code to provide the functionality described herein may be stored on a tangible, non-transitory computer readable media. In some cases, the entire set of instructions may be stored concurrently on the media, or in some cases, different parts of the instructions may be stored on the same media at different times, e.g., a copy may be created by writing program code to a first-in-first-out buffer in a network interface, where some of the instructions are pushed out of the buffer before other portions of the instructions are written to the buffer, with all of the instructions residing in memory on the buffer, just not all at the same time.

I/O interface 2350 may be configured to coordinate I/O traffic between processors 2310*a*-2310*n*, system memory 2320, network interface 2340, I/O devices 2360, and/or other peripheral devices. I/O interface 2350 may perform protocol, timing, or other data transformations to convert data signals from one component (e.g., system memory 2320) into a format suitable for use by another component (e.g., processors 2310*a*-2310*n*). I/O interface 2350 may include support for devices attached through various types of peripheral buses, such as a variant of the Peripheral Component Interconnect (PCI) bus standard or the Universal Serial Bus (USB) standard.

Embodiments of the techniques described herein may be implemented using a single instance of computer system 2300 or multiple computer systems 2300 configured to host different portions or instances of embodiments. Multiple computer systems 900 may provide for parallel or sequential processing/execution of one or more portions of the techniques described herein.

Those skilled in the art will appreciate that computer system 2300 is merely illustrative and is not intended to limit the scope of the techniques described herein. Computer system 2300 may include any combination of devices or software that may perform or otherwise provide for the performance of the techniques described herein. For example, computer system 2300 may include or be a combination of a cloud-computing system, a data center, a server rack, a server, a virtual server, a desktop computer, a laptop computer, a tablet computer, a server device, a client device, a mobile telephone, a personal digital assistant (PDA), a mobile audio or video player, a game console, a vehicle-mounted computer, a television or device connected to a television (e.g., Apple TV™), a Global Positioning System (GPS), a smartwatch, a wearable device, or the like. Computer system 2300 may also be connected to other devices that are not illustrated, or may operate as a stand-alone system. In addition, the functionality provided by the illustrated components may in some embodiments be combined in fewer components or distributed in additional components. Similarly, in some embodiments, the functionality of some of the illustrated components may not be provided or other additional functionality may be available.

Those skilled in the art will also appreciate that while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the illustrated computer system via inter-computer communication. Some or all of the system components or data structures may also be stored (e.g., as instructions or structured data) on a computer-accessible medium or a portable article to be read by an appropriate drive, various examples of which are described above. In some embodiments, instructions stored on a computer-accessible medium separate from computer system 2300 may be transmitted to computer system 2300 via transmission media or signals such as electrical, electromagnetic, or digital signals, conveyed via a communication medium such as a network or a wireless link. Various embodiments may further include receiving, sending, or storing instructions or data implemented in accordance with the foregoing description upon a computer-accessible medium. Accordingly, the present invention may be practiced with other computer system configurations.

Figure 24:
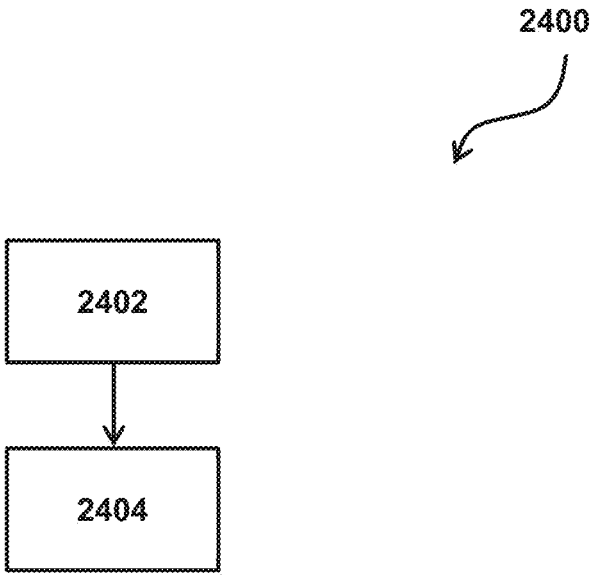
FIG. 24 is a flow chart that illustrates a pumping method performed by the pumping system shown in FIG. 2, the hydraulic circuit shown in FIG. 6, the exemplary computing system shown in FIG. 23 (e.g., using the computational model), and/or other components, in accordance with various embodiments.

FIG. 24 is a flow chart that illustrates a pumping method 2400 performed by pumping system 200 shown in FIG. 2, hydraulic circuit 600 shown in FIG. 6, the exemplary computing system shown in FIG. 23 (e.g., using the computational model), and/or other components, in accordance with various embodiments. Note that the stretchable tube, the actuator, and/or other components may be formed at more or more different scales. For example, the stretchable tube and the actuator may comprise a micro or nano scale structure. As another example, the stretchable tube and the actuator may comprise a physiological scale structure, configured to model the heart and/or other elements of human and/or animal anatomy.

Method 2400 begins with holding (operation 2402) fluid with a stretchable tube. In some embodiments, the stretchable tube comprises an elastic material, for example. The stretchable tube may be fixed at or near an outlet end, and configured to be stretched by an actuator (as described herein) at or near an inlet end. In some embodiments, the stretchable tube comprises a rigid connector configured to couple a first side of the stretchable tube to a second side of the stretchable tube. In some embodiments, the stretchable tube is tapered, has one or more side branches, and/or has other characteristics. The stretchable tube may be similar to and/or the same as stretchable tube 202 shown in FIG. 2 (and other figures) and described above.

Method 2400 comprises longitudinally stretching (operation 2404) the stretchable tube with an actuator coupled to the tube. In some embodiments, the actuator comprises a cam follower mechanism and a stepper motor configured to drive the cam follower mechanism, and/or other components. The actuator is configured to longitudinally stretch and release the stretchable tube to create waves on the stretchable tube and within the fluid that propagate and reflect at one or more reflection sites along the stretchable tube to create wave pumping, which drives the fluid and generates net flow in a flow direction. The reflection sites may comprise a stiffened portion of a wall of the stretchable tube, a bifurcation in the stretchable tube, a connection to a rigid tube, and/or other reflection sites.

The outlet end of the stretchable tube may be fixed at a single point to create wave reflection and/or for other purposes. In some embodiments, the actuator comprises a first portion configured for longitudinally stretching a first portion of an elastic deformable wall on a first side of the stretchable tube to create waves that propagate on the first side of the stretchable tube, and a second portion configured for longitudinally stretching a second portion of the elastic deformable wall on a second side of the tube to create symmetric stretching on the first and second sides of the stretchable tube. In some embodiments, (e.g., when the stretchable tube comprises one or more side branches), one or more actuators are coupled to one or more side branches to longitudinally stretch and release the one or more side branches.

In some embodiments, operation 2404 comprises setting a stretching frequency with the actuator to achieve a maximum pumping volume of the fluid based on wave characteristics in the stretchable tube including elasticity, frequency, and locations of reflection sites. Changing a length of the stretchable tube may modify a reflection site and/or a pumping rate, for example. Changing an elasticity, a wall thickness, an inner radius, and/or other properties of the stretchable tube may modify a speed of wave propagation, the pumping rate, and/or other characteristics of the pumping system. The actuator may be similar to and/or the same as actuator 204 shown in FIG. 2 (and other figures) and described above.

In some embodiments, method 2400 comprises controlling, with a controller of a hydraulic circuit coupled to the actuator, the actuator to stretch and release the stretchable tube. This may include controlling the actuator to stretch and release the stretchable tube at a specific frequency, with a specific magnitude, over a specific time (e.g., an oscillatory cycle). In some embodiments, the hydraulic circuit comprises a reservoir tank configured to supply the fluid, a fixture configured to hold the stretchable tube and/or the actuator, one or more sensors configured to generate one or more output signals conveying information related to stretching and releasing of the stretchable tube by the actuator and/or pumping by the stretchable tube, a data recorder configured to record the information in the one or more output signals, and/or other components.

In block diagrams, illustrated components are depicted as discrete functional blocks, but embodiments are not limited to systems in which the functionality described herein is organized as illustrated. The functionality provided by each of the components may be provided by software or hardware modules that are differently organized than is presently depicted, for example such software or hardware may be intermingled, conjoined, replicated, broken up, distributed (e.g. within a data center or geographically), or otherwise differently organized. The functionality described herein may be provided by one or more processors of one or more computers executing code stored on a tangible, non-transitory, machine readable medium. In some cases, notwithstanding use of the singular term "medium," the instructions may be distributed on different storage devices associated with different computing devices, for instance, with each computing device having a different subset of the instructions, an implementation consistent with usage of the singular term "medium" herein. In some cases, third party content delivery networks may host some or all of the information conveyed over networks, in which case, to the extent information (e.g., content) is said to be supplied or otherwise provided, the information may provided by sending instructions to retrieve that information from a content delivery network.

The reader should appreciate that the present application describes several inventions. Rather than separating those inventions into multiple isolated patent applications, applicants have grouped these inventions into a single document because their related subject matter lends itself to economies in the application process. But the distinct advantages and aspects of such inventions should not be conflated. In some cases, embodiments address all of the deficiencies noted herein, but it should be understood that the inventions are independently useful, and some embodiments address only a subset of such problems or offer other, unmentioned benefits that will be apparent to those of skill in the art reviewing the present disclosure. Due to cost constraints, some inventions disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such inventions or all aspects of such inventions.

It should be understood that the description and the drawings are not intended to limit the invention to the particular form disclosed, but to the contrary, the intention is to cover all modifications, equivalents, and alternatives falling within the spirit and scope of the present invention as defined by the appended claims. Further modifications and alternative embodiments of various aspects of the invention will be apparent to those skilled in the art in view of this description. Accordingly, this description and the drawings are to be construed as illustrative only and are for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device.

Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. The terms "first", "second", "third," "given" and so on, if used in the claims, are used to distinguish or otherwise identify, and not to show a sequential or numerical limitation. As is the case in ordinary usage in the field, data structures and formats described with reference to uses salient to a human need not be presented in a human-intelligible format to constitute the described data structure or format, e.g., text need not be rendered or even encoded in Unicode or ASCII to constitute text; images, maps, and data-visualizations need not be displayed or decoded to constitute images, maps, and data-visualizations, respectively; speech, music, and other audio need not be emitted through a speaker or decoded to constitute speech, music, or other audio, respectively. Computer implemented instructions, commands, and the like are not limited to executable code and can be implemented in the form of data that causes functionality to be invoked, e.g., in the form of arguments of a function or API call. To the extent bespoke noun phrases (and other coined terms) are used in the claims and lack a self-evident construction, the definition of such phrases may be recited in the claim itself, in which case, the use of such bespoke noun phrases should not be taken as invitation to impart additional limitations by looking to the specification or extrinsic evidence.

In this patent application and eventual patent, to the extent any U.S. patents, U.S. patent applications, or other materials (e.g., articles) have been incorporated by reference, the text of such materials is only incorporated by reference to the extent that no conflict exists between such material and the statements and drawings set forth herein. In the event of such conflict, the text of the present document governs, and terms in this document should not be given a narrower reading in virtue of the way in which those terms are used in other materials incorporated by reference.

The present techniques will be better understood with reference to the following enumerated embodiments, which may be combined in any combination.

1. A pumping system, comprising: a stretchable tube, the stretchable tube configured to hold a fluid; and an actuator coupled to the tube, the actuator configured to longitudinally stretch and release the stretchable tube to create waves on the stretchable tube and within the fluid that propagate and reflect at one or more reflection sites along the stretchable tube to create wave pumping, which drives the fluid and generates net flow in a flow direction.

2. The system of embodiment 1, wherein the reflection sites comprise a stiffened portion of a wall of the stretchable tube, a bifurcation in the stretchable tube, and/or a connection to a rigid tube.

3. The system of any of the previous embodiments, wherein the stretchable tube comprises an clastic material.

4. The system of any of the previous embodiments, wherein the stretchable tube is fixed at or near an outlet end, and configured to be stretched by the actuator at or near an inlet end.

5. The system of any of the previous embodiments, wherein the outlet end is fixed at a single point to create wave reflection.

6. The system of any of the previous embodiments, wherein the actuator comprises a cam follower mechanism and a stepper motor configured to drive the cam follower mechanism.

7. The system of any of the previous embodiments, wherein a length of the stretchable tube is configured to be changed to modify a reflection site and/or a pumping rate.

8. The system of any of the previous embodiments, wherein an elasticity of the stretchable tube is configured to be changed to modify a speed of wave propagation and/or a pumping rate.

9. The system of any of the previous embodiments, wherein a wall thickness of the stretchable tube is configured to be changed to modify a speed of wave propagation and/or a pumping rate.

10. The system of any of the previous embodiments, wherein an inner radius of the stretchable tube is configured to be changed to modify a speed of wave propagation and/or a pumping rate.

11. The system of any of the previous embodiments, wherein a stretching frequency from the actuator is configured to be set to achieve a maximum pumping volume of the fluid based on wave characteristics in the stretchable tube including elasticity, frequency, and locations of reflection sites.

12. The system of any of the previous embodiments, further comprising a hydraulic circuit, the hydraulic circuit comprising a controller coupled to the actuator and configured to control the actuator to stretch and release the stretchable tube.

13. The system of any of the previous embodiments, wherein the controller is configured to control the actuator to stretch and release the stretchable tube at a specific frequency, with a specific magnitude, over a specific time.

14. The system of any of the previous embodiments, wherein the specific time is a period of an oscillatory cycle.

15. The system of any of the previous embodiments, wherein the hydraulic circuit further comprises a reservoir tank configured to supply the fluid, a fixture configured to hold the stretchable tube and/or the actuator, one or more sensors configured to generate one or more output signals conveying information related to stretching and releasing of the stretchable tube by the actuator and/or pumping by the stretchable tube, and/or a data recorder configured to record the information in the one or more output signals.

16. The system of any of the previous embodiments, wherein the actuator comprises a first portion configured for longitudinally stretching a first portion of an elastic deformable wall on a first side of the stretchable tube to create waves that propagate on the first side of the stretchable tube, and a second portion configured for longitudinally stretching a second portion of the elastic deformable wall on a second side of the tube to create symmetric stretching on the first and second sides of the stretchable tube.

17. The system of any of the previous embodiments, wherein the stretchable tube comprises a rigid connector configured to couple the first side of the stretchable tube to the second side of the stretchable tube.

18. The system of any of the previous embodiments, wherein the stretchable tube and the actuator comprise a micro or nano scale structure.

19. The system of any of the previous embodiments, wherein the stretchable tube is tapered.

20. The system of any of the previous embodiments, wherein the stretchable tube comprises one or more side branches, and wherein one or more actuators are coupled to the one or more side branches to longitudinally stretch and release the one or more side branches.

21. A pumping method, comprising: holding, with a stretchable tube, a fluid; and longitudinally stretching the stretchable tube with an actuator coupled to the tube, the actuator configured to longitudinally stretch and release the stretchable tube to create waves on the stretchable tube and within the fluid that propagate and reflect at one or more reflection sites along the stretchable tube to create wave pumping, which drives the fluid and generates net flow in a flow direction.

22. The method of embodiment 21, wherein the reflection sites comprise a stiffened portion of a wall of the stretchable tube, a bifurcation in the stretchable tube, and/or a connection to a rigid tube.

23. The method of any of the previous embodiments, wherein the stretchable tube comprises an elastic material.

24. The method of any of the previous embodiments, wherein the stretchable tube is fixed at or near an outlet end, and configured to be stretched by the actuator at or near an inlet end.

25. The method of any of the previous embodiments, wherein the outlet end is fixed at a single point to create wave reflection.

26. The method of any of the previous embodiments, wherein the actuator comprises a cam follower mechanism and a stepper motor configured to drive the cam follower mechanism.

27. The method of any of the previous embodiments, further comprising changing a length of the stretchable tube to modify a reflection site and/or a pumping rate.

28. The method of any of the previous embodiments, further comprising changing an elasticity of the stretchable tube to modify a speed of wave propagation and/or a pumping rate.

29. The method of any of the previous embodiments, further comprising changing a wall thickness of the stretchable tube to modify a speed of wave propagation and/or a pumping rate.

30. The method of any of the previous embodiments, further comprising changing an inner radius of the stretchable tube to modify a speed of wave propagation and/or a pumping rate.

31. The method of any of the previous embodiments, further comprising setting a stretching frequency with the actuator to achieve a maximum pumping volume of the fluid based on wave characteristics in the stretchable tube including elasticity, frequency, and locations of reflection sites.

32. The method of any of the previous embodiments, further comprising controlling, with a controller of a hydraulic circuit coupled to the actuator, the actuator to stretch and release the stretchable tube.

33. The method of any of the previous embodiments, further comprising controlling the actuator to stretch and release the stretchable tube at a specific frequency, with a specific magnitude, over a specific time.

34. The method of any of the previous embodiments, wherein the specific time is a period of an oscillatory cycle.

35. The method of any of the previous embodiments, wherein the hydraulic circuit further comprises a reservoir tank configured to supply the fluid, a fixture configured to hold the stretchable tube and/or the actuator, one or more sensors configured to generate one or more output signals conveying information related to stretching and releasing of the stretchable tube by the actuator and/or pumping by the stretchable tube, and/or a data recorder configured to record the information in the one or more output signals.

36. The method of any of the previous embodiments, wherein the actuator comprises a first portion configured for longitudinally stretching a first portion of an elastic deformable wall on a first side of the stretchable tube to create waves that propagate on the first side of the stretchable tube, and a second portion configured for longitudinally stretching a second portion of the elastic deformable wall on a second side of the tube to create symmetric stretching on the first and second sides of the stretchable tube.

37. The method of any of the previous embodiments, wherein the stretchable tube comprises a rigid connector configured to couple the first side of the stretchable tube to the second side of the stretchable tube.

38. The method of any of the previous embodiments, wherein the stretchable tube and the actuator comprise a micro or nano scale structure.

39. The method of any of the previous embodiments, wherein the stretchable tube is tapered.

40. The method of any of the previous embodiments, wherein the stretchable tube comprises one or more side branches, and wherein one or more actuators are coupled to the one or more side branches to longitudinally stretch and release the one or more side branches.

41. A tangible, non-transitory, machine-readable medium storing instructions that when executed by a data processing apparatus cause the data processing apparatus to execute an electronic computational model of the system of any of embodiments 1-20, and/or one or more operations of the method of any of embodiments 21-40.

While the foregoing has described what are considered to constitute the present teachings and/or other examples, it is understood that various modifications may be made thereto and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A pumping system, comprising:

a stretchable tube, the stretchable tube configured to hold a fluid; and an actuator coupled to the tube, the actuator configured to longitudinally stretch and release the stretchable tube to create waves on the stretchable tube and within the fluid that propagate and reflect at one or more reflection sites along the stretchable tube to create wave pumping, which drives the fluid and generates net flow in a flow direction.

2. The system of claim 1, wherein the reflection sites comprise a stiffened portion of a wall of the stretchable tube, a bifurcation in the stretchable tube, and/or a connection to a rigid tube.

3. The system of claim 1, wherein the stretchable tube comprises an elastic material.

4. The system of claim 1, wherein the stretchable tube is fixed at or near an outlet end, and configured to be stretched by the actuator at or near an inlet end.

5. The system of claim 4, wherein the outlet end is fixed at a single point to create wave reflection.

6. The system of claim 1, wherein the actuator comprises a cam follower mechanism and a stepper motor configured to drive the cam follower mechanism.

7. The system of claim 1, wherein a length of the stretchable tube is configured to be changed to modify a reflection site of the plurality of reflection sites and/or a pumping rate.

8. The system of claim 1, wherein an elasticity of the stretchable tube is configured to be changed to modify a speed of wave propagation and/or a pumping rate.

9. The system of claim 1, wherein a wall thickness of the stretchable tube is configured to be changed to modify a speed of wave propagation and/or a pumping rate.

10. The system of claim 1, wherein an inner radius of the stretchable tube is configured to be changed to modify a speed of wave propagation and/or a pumping rate.

11. The system of claim 1, wherein a stretching frequency from the actuator is configured to be set to achieve a maximum pumping volume of the fluid based on wave characteristics in the stretchable tube including elasticity, frequency, and locations of reflection sites.

12. The system of claim 1, further comprising a hydraulic circuit, the hydraulic circuit comprising a controller coupled to the actuator and configured to control the actuator to stretch and release the stretchable tube.

13. The system of claim 12, wherein the controller is configured to control the actuator to stretch and release the stretchable tube at a specific frequency, with a specific magnitude, over a specific time.

14. The system of claim 13, wherein the specific time is a period of an oscillatory cycle.

15. The system of claim 12, wherein the hydraulic circuit further comprises a reservoir tank configured to supply the fluid, a fixture configured to hold the stretchable tube and/or the actuator, one or more sensors configured to generate one or more output signals conveying information related to stretching and releasing of the stretchable tube by the actuator and/or pumping by the stretchable tube, and/or a data recorder configured to record the information in the one or more output signals.

16. The system of claim 15, wherein the actuator comprises a first portion configured for longitudinally stretching a first portion of an elastic deformable wall on a first side of the stretchable tube to create waves that propagate on the first side of the stretchable tube, and a second portion configured for longitudinally stretching a second portion of the elastic deformable wall on a second side of the tube to create symmetric stretching on the first and second sides of the stretchable tube.

17. The system of claim 16, wherein the stretchable tube comprises a rigid connector configured to couple the first side of the stretchable tube to the second side of the stretchable tube.

18. The system of claim 1, wherein the stretchable tube and the actuator comprise a micro or nano scale structure.

19. The system of claim 1, wherein the stretchable tube is tapered.

20. The system of claim 1, wherein the stretchable tube comprises one or more side branches, and wherein one or more actuators are coupled to the one or more side branches to longitudinally stretch and release the one or more side branches.

* * * * *